US008107863B2

(12) United States Patent
Yamazaki et al.

(10) Patent No.: US 8,107,863 B2
(45) **Date of Patent: *Jan. 31, 2012**

(54) DEVELOPING DEVICE AND IMAGE FORMING APPARATUS

(75) Inventors: Soichi Yamazaki, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 545 days.

This patent is subject to a terminal disclaimer.

(21) Appl. No.: 12/040,720

(22) Filed: Feb. 29, 2008

(65) Prior Publication Data

US 2008/0292367 A1 Nov. 27, 2008

(30) Foreign Application Priority Data

Mar. 1, 2007 (JP) ..... 2007-052046
Nov. 26, 2007 (JP) ..... 2007-305135

(51) Int. Cl.
*G03G 15/00* (2006.01)
*G03G 9/00* (2006.01)
*G03G 13/08* (2006.01)

(52) U.S. Cl. ..... 399/286; 399/27; 399/259; 430/110.4; 430/123.3; 430/108.3

(58) Field of Classification Search ..... 399/27, 399/259, 286; 430/108, 108.3, 108.11, 110.4, 430/123.3
See application file for complete search history.

(56) References Cited

U.S. PATENT DOCUMENTS 4,910,556 A 3/1990 Namiki
5,502,552 A 3/1996 Iwata
5,750,304 A 5/1998 Yamaguchi et al.
5,946,536 A 8/1999 Suzuki
6,941,100 B2 9/2005 Yamada et al.
7,074,535 B2 7/2006 Saito et al.
7,198,874 B2 4/2007 Saito et al.
2001/0003635 A1 6/2001 Goto
2004/0115551 A1* 6/2004 Sugiyama et al. ..... 430/109.4
2004/0137354 A1 7/2004 Yamazaki et al.
2006/0263711 A1* 11/2006 Yuasa et al. ..... 430/108.4
2008/0076052 A1* 3/2008 Nakamura et al. ..... 430/103
2008/0199221 A1* 8/2008 Teshima et al. ..... 399/237
2008/0199801 A1* 8/2008 Akioka et al. ..... 430/112

FOREIGN PATENT DOCUMENTS

EP 924572 A1 * 6/1999

(Continued)

*Primary Examiner* — David Gray
*Assistant Examiner* — Francis Gray
(74) *Attorney, Agent, or Firm* — DLA Piper LLP (US)

(57) ABSTRACT

A developing device and an image forming apparatus which can form a printing image having high resolution and a high quality level, while resolving various problems resulted from the use of small particle size toner particles are provided. The developing device includes a toner constituted of resin base particles containing a coloring agent and a binder resin, and silicone oil and/or fluoro oil added to the resin base particles, a toner receiving portion for receiving the toner, and a developing roller having an outer peripheral surface and an irregularity section for carrying the toner, the irregularity section formed on the outer peripheral surface and including a plurality of depression portions and/or protrusion portions provided regularly and uniformly, wherein an average particle size of the resin base particles in volume basis is in the range of 2 to 4 μm, and an added amount of the silicone oil and/or fluoro oil to the resin base particles is in the range of 0.05 to 2 mass %.

12 Claims, 6 Drawing Sheets

FOREIGN PATENT DOCUMENTS

| | | | | |
|---|---|---|---|---|
| JP | 07-013410 | | | 1/1995 |
| JP | 09015900 | A | | 1/1997 |
| JP | 09124885 | A | * | 5/1997 |
| JP | 09-319208 | | | 12/1997 |
| JP | 10111582 | A | | 4/1998 |
| JP | 2001-166527 | | | 6/2001 |
| JP | 2003-057940 | | | 2/2003 |
| JP | 2003195554 | A | | 7/2003 |
| JP | 2003208012 | A | | 7/2003 |
| JP | 2003263020 | A | | 9/2003 |
| JP | 2004286824 | A | | 10/2004 |
| JP | 2005148684 | A | | 6/2005 |
| JP | 2005345861 | A | | 12/2005 |
| JP | 2006039446 | A | | 2/2006 |
| JP | 2006145889 | A | | 6/2006 |
| JP | 2006163160 | A | | 6/2006 |
| JP | 2006163302 | A | | 6/2006 |
| JP | 2006259384 | A | | 9/2006 |

* cited by examiner

DEVELOPING DEVICE AND IMAGE FORMING APPARATUS

CROSS-REFERENCE TO RELATED APPLICATION

This application claims priorities to Japanese Patent Applications No. 2007-052046 filed on Mar. 1, 2007 and No. 2007-305135 filed on Nov. 26, 2007 which are hereby expressly incorporated by reference herein in their entireties.

BACKGROUND

1. Technical Field

The present invention relates to a developing device and an image forming apparatus, and more specifically to a developing device and an image forming apparatus provided with the developing device.

2. Related Art

In general, image forming apparatuses such as a printer, a copier and a facsimile, which utilize electrophotography, are adapted to form a printing image on a recording medium such as a paper through a series of image forming processes including an electrifying step, an exposure step, a developing step, a transfer step, a fixing step and the like.

Such image forming apparatuses are provided with a developing device having a developing roller for carrying a toner thereon. The developing device is used in a state that the developing roller is arranged to face a photosensitive dram carrying an electrostatic latent image thereon. And, the developing device forms a toner image from the latent image by visualizing (developing) the same by applying the toner from the developing roller to the photosensitive dram.

Meanwhile, recently, from a viewpoint of formation of a printing image having high resolution, it is proposed to use small particle size toner particles each having a particle size equal to or smaller than 4 μm.

However, in the case of a dry type toner, if a particle size of each of toner particles contained therein would be merely set to a small value, the following problems occur. Namely, dispersal of the toner particles is likely to occur, and it becomes difficult to carry and convey the toner particles on the developing roller reliably.

On the other hand, conventionally, in order to prevent occurrence of a filming phenomenon of the toner on the photosensitive dram or the developing roller, there is known a toner which is constituted of resin base particles containing a binder resin and a coloring agent, and a small amount of oil added (externally added) to the resin base particles (for example, JP-A-2001-166527).

In such a toner containing the oil, even if a particle size of each of the resin base particles is set to a small value, since aggregates, which are formed by aggregation of the resin base particles via the oil, can behave as large particle size toner particles apparently, it is supposed that the above problems resulted from the use of the small particle size toner particles can be resolved.

On the other hand, however, in such a toner, since a particle size variation is likely to occur among the aggregates of the resin base particles, a charge property of the resin base particles becomes ununiform easily. As a result, there is a fear that a developing characteristic and a transfer property are adversely affected.

In particular, such an adverse affect is highly likely to occur in the small particle size toner particles. Therefore, even if the oil is merely added to the small particle size toner particles, it is difficult to form a printing image having high resolution.

SUMMARY

Accordingly, it is objects of the present invention to provide a developing device and an image forming apparatus which can form a printing image having high resolution and a high quality level, while resolving various problems resulted from the use of small particle size toner particles.

These objects are achieved by the invention described below. In a first aspect of the invention, there is provided a developing device which comprises a toner constituted of resin base particles containing a coloring agent and a binder resin, and silicone oil and/or fluoro oil added to the resin base particles, a toner receiving portion for receiving the toner, and a developing roller having an outer peripheral surface and an irregularity section for carrying the toner, the irregularity section formed on the outer peripheral surface and including a plurality of depression portions and/or protrusion portions provided regularly and uniformly, wherein an average particle size of the resin base particles in volume basis is in the range of 2 to 4 μm, and an added amount of the silicone oil and/or fluoro oil to the resin base particles is in the range of 0.05 to 2 mass %.

According to the developing device, although each of the resin base particles constituting the toner has a small particle size, aggregates of the resin base particles can behave as though they are large particle size toner particles within the toner receiving portion and on the developing roller, whereas the resin base particles can behave as small particle size toner particles on a photosensitive dram.

In addition, by contact of the aggregates with the irregularity section, particle sizes of the aggregates can be equalized, and the silicone oil and/or fluoro oil can be dispersed uniformly in the toner. Therefore, a printing image having high resolution and a high quality level can be formed, while resolving various problems resulted from the use of small particle size toner particles.

In the developing device according to the invention, it is preferred that the irregularity section includes a plurality of first grooves extending in a mutually parallel relationship and a plurality of second grooves intersecting the first grooves and extending in a mutually parallel relationship.

This makes it possible to provide the depression portions and/or protrusion portions regularly in spite of a relatively simple structure.

In the developing device according to the invention, it is preferred that the irregularity section is formed using a die rolling method.

This makes it possible to form relatively simply and reliably an irregularity section in which the depression portions and/or protrusion portions are provided regularly.

In the developing device according to the invention, it is preferred that a depth of each first groove and/or each second groove is larger than the average particle size of the resin base particles.

This makes it possible to adjust a particle size of each of the aggregates of the resin base particles to a value corresponding to the depth of each depression portion of the irregularity section by making the aggregates contact with the irregularity section. As a result, it is possible to allow the resin base particles to exist as the aggregates on the developing roller more reliably, and to prevent a toner fly (dispersal of small particle size toner particles) more reliably.

In the developing device according to the invention, it is preferred that the depth of each first groove and/or each second groove is equal to or smaller than 2 times of the average particle size of the resin base particles.

This makes it possible to optimize the particle size of each of the aggregates, and therefore a charge property of each of the resin base particles can be improved while preventing the toner fly.

In the developing device according to the invention, it is preferred that the developing device further comprises a toner supply roller provided so as to make contact with the developing roller, the toner supply roller having an outer peripheral surface and supplying the toner to the irregularity section of the developing roller while retaining the toner on the outer peripheral surface thereof.

This makes it possible for the aggregates of the resin base particles to make contact with the irregularity section between the developing roller and the toner supply roller. As a result, particle sizes of the aggregates can be equalized more reliably, and the silicone oil and/or fluoro oil can be uniformly dispersed in the toner more reliably.

In the developing device according to the invention, it is preferred that the toner supply roller includes a hollow or solid cylindrical main body having an outer peripheral surface, and an elastic porous layer provided on the outer peripheral surface of the main body and having a plurality of pores, and a pitch between the first grooves and a pitch between the second grooves are respectively smaller than an average size of the pores in the elastic porous layer.

This makes it possible to flake the aggregates of the resin base particles existing within the pores of the elastic porous layer of the toner supply roller due to contact with the irregularity section. As a result, the silicone oil and/or fluoro oil can be dispersed in the toner more uniformly.

In the developing device according to the invention, it is preferred that the developing device further comprises a restriction blade provided so as to make contact with the outer peripheral surface of the developing roller for restricting an amount of the toner on the irregularity section of the developing roller to a predetermined amount.

This makes it possible for the aggregates of the resin base particles to make contact with the irregularity section between the developing roller and the restriction blade. As a result, particle sizes of the aggregates can be equalized more reliably, and the silicone oil and/or fluoro oil can be uniformly dispersed in the toner more reliably.

In the developing device according to the invention, it is preferred that each first groove and each second groove extend in a direction inclined with respect to a circumferential direction of the outer peripheral surface of the developing roller.

This makes it possible to convey the toner while being moved along an axis line direction of the developing roller in accordance with rotation thereof. Therefore, particle sizes of the aggregates and dispersion of the silicone oil and/or fluoro oil in the toner can be equalized in the axis line direction of the developing roller.

In the developing device according to the invention, it is preferred that in the case where the average particle size of the resin base particles in volume basis is defined as "Dv" and an average particle size of the resin base particles in number basis is defined as "Dn", Dv/Dn is in the range of 1 to 1.1.

This makes it possible to obtain aggregates in which gaps having adequate distances are formed between the resin base particles. As a result, such aggregates can be crushed easily at a desired time (specifically, at a time when the aggregates exist between the photosensitive dram and the developing roller).

In the developing device according to the invention, it is preferred that the silicone oil is dimethylsilicone oil.

The dimethylsilicone oil is a harmless to humans, and has an excellent lubricity, chemical stability and thermal stability. Namely, the dimethylsilicone oil can be preferably used as an additive agent for the toner having an excellent safety and stability.

In the developing device according to the invention, it is preferred that a kinetic viscosity at 25° C. of the dimethylsilicone oil is in the range of 50 to 300 $mm^2/s$.

This makes it possible to obtain a toner which can exhibit an excellent developing characteristic stably.

In a first aspect of the invention, there is provided an image forming apparatus which comprises a latent image carrier for carrying a latent image thereon, and a developing device for visualizing the latent image as a toner image by applying a toner, which is constituted of resin base particles containing a coloring agent and a binder resin, and silicone oil and/or fluoro oil added to the resin base particles, to the latent image carrier, wherein the developing device comprising the toner, a toner receiving portion for receiving the toner, and a developing roller having an outer peripheral surface and an irregularity section for carrying the toner, the irregularity section formed on the outer peripheral surface and including a plurality of depression portions and/or protrusion portions provided regularly and uniformly, wherein an average particle size of the resin base particles in volume basis is in the range of 2 to 4 μm, and an added amount of the silicone oil and/or fluoro oil to the resin base particles is in the range of 0.05 to 2 mass %.

This makes it possible to form a printing image (toner image) having high resolution and a high quality level, while resolving various problems resulted from the use of small particle size toner particles.

DESCRIPTION OF EXEMPLARY EMBODIMENTS

Now, preferred embodiments of a developing device and an image forming apparatus in accordance with the present invention will be described with reference to the accompanying drawings.

Image Forming Apparatus

Figure 1:
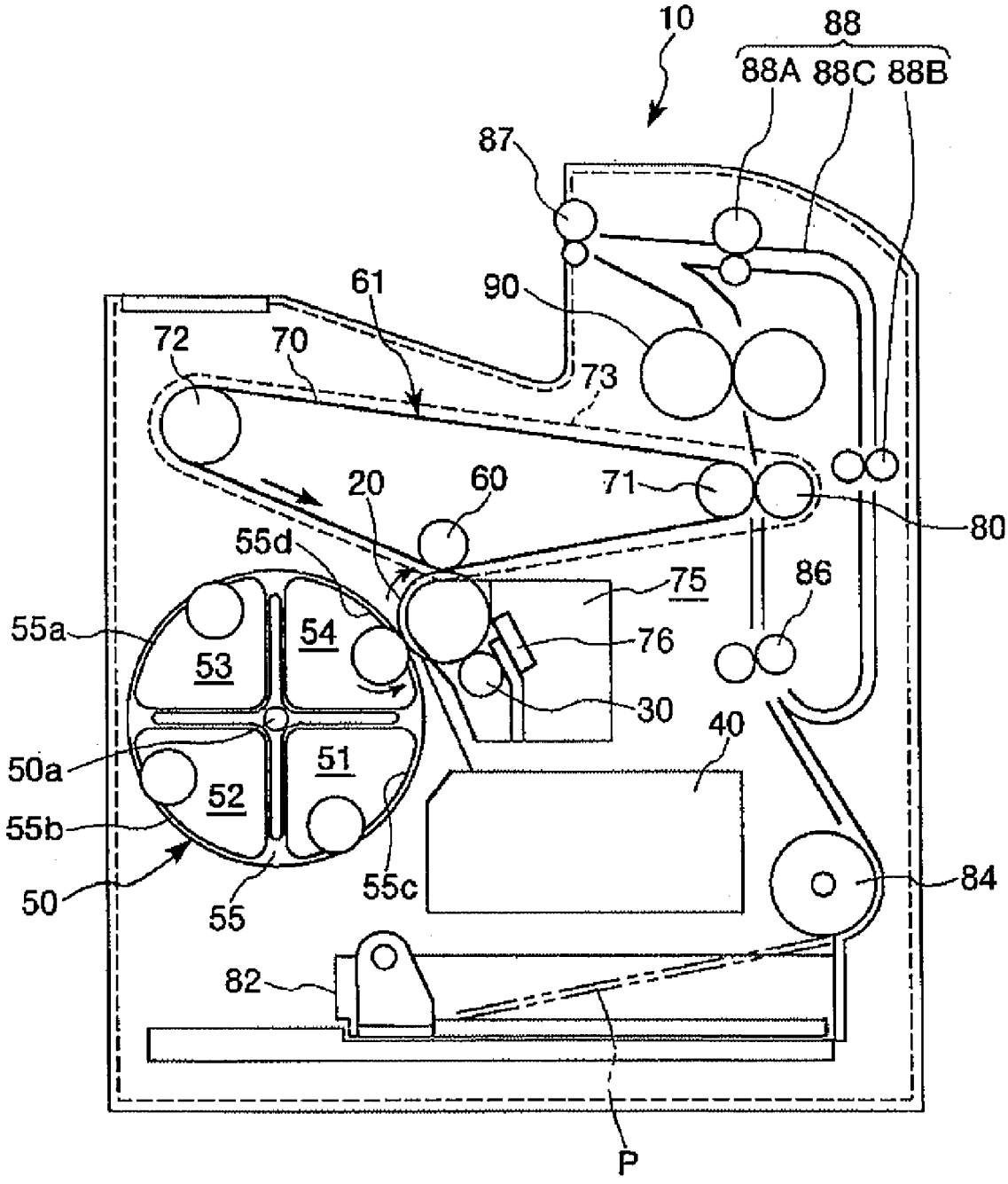
FIG. 1 is a schematic sectional view showing an overall configuration of an image forming apparatus in accordance with one embodiment of the invention.

FIG. 1 is a schematic sectional view showing an overall configuration of an image forming apparatus in accordance with one embodiment of the invention.

Referring to FIG. 1, the image forming apparatus 10 of this embodiment is an apparatus that records a printing image on a recording medium through a series of image forming processes mainly including an exposure step, a developing step, a transfer step and a fixing step.

As shown in FIG. 1, the image forming apparatus 10 includes a photosensitive dram 20 which carries a latent image and rotates in a direction of an arrow shown in each of the drawings. The image forming apparatus 10 further includes an electrifying unit 30, an exposure unit 40, a developing unit 50, an intermediate transfer body 61 and a cleaning unit 75, and they are arranged in the named order along a rotational direction of the photosensitive dram 20.

Further, in the lower portion in FIG. 1, the image forming apparatus 10 includes a paper supply tray 82 which holds a recording medium "P" such as a paper. Further, the intermediate transfer body 61 and a fixing unit 90 are arranged in the named order downstream from the paper supply tray 82 in a conveying direction of the recording medium P.

Furthermore, in the case where a printing image is to be formed on both sides of a recording medium P, the image forming apparatus 10 is provided with a conveying section 88 for turning over the recording medium P, which has undergone a fixing process on one side thereof by the fixing unit 90, and returning it to a secondary transfer position described below.

The photosensitive dram 20 includes a cylindrical conductive base material (not shown in the drawings) having an outer peripheral surface, and a photosensitive layer (not shown in the drawings) formed on the outer peripheral surface of the conductive base material, and is rotatable about an axis thereof in a direction of the arrow shown in FIG. 1.

The electrifying unit 30 is a device for uniformly electrifying an outer peripheral surface of the photosensitive dram 20 by corona charging or the like. The exposure unit 40 is a device that forms an electrostatic latent image on the uniformly electrified photosensitive dram 20 by irradiating a laser beam in accordance with image information received from a host computer such as a personal computer or the like not shown in the drawings.

The developing unit 50 includes four developing devices, namely, a black developing device 51, a magenta developing device 52, a cyan developing device 53 and a yellow developing device 54. These developing devices 51, 52, 53 and 54 are devices which make the latent image visible as a toner image (printing image) and are selectively used in accordance with the latent image formed on the photosensitive dram 20.

The black developing device 51 uses a black (K) toner as a developing agent, the magenta developing device 52 uses a magenta (M) toner, the cyan developing device 53 uses a cyan (C) toner, and the yellow developing device 54 uses a yellow (Y) toner to carry out development of the latent image.

The YMCK developing unit 50 in this embodiment is rotatable to ensure that the four developing devices 51, 52, 53 and 54 face the photosensitive dram 20 selectively. Namely, in the YMCK developing unit 50, the four developing devices 51, 52, 53 and 54 are held respectively in four holding portions 55*a*, 55*b*, 55*c* and 55*d* of a holding body 55 which is rotatable around a shaft 50*a*.

By rotating the holding body 55, the four developing devices 51, 52, 53 and 54 are selectively allowed to face the photosensitive dram 20 while maintaining a relative relationship in position. In this regard, it is to be noted that each of the developing devices 51, 52, 53 and 54 will be described below in detail.

An intermediate transfer body 61 includes an endless belt type intermediate transfer belt 70 which is wound around the primary transfer roller 60, a driven roller 72 and a drive roller 71. The intermediate transfer belt 70 is driven rotationally at roughly the same circumferential speed as that of the photosensitive dram 20 in a direction of the arrow shown in FIG. 1.

The primary transfer roller 60 is a device for transferring a monochrome toner image formed on the photosensitive dram 20 to the intermediate transfer belt 70.

A toner image having at least one color of black, magenta, cyan and yellow is carried on the intermediate transfer belt 70. For example, when forming a full color image, transferring is carried out by sequentially layering toner images having the four colors including black, magenta, cyan and yellow to form a full color toner image.

In this embodiment, the drive roller 71 also functions as a backup roller of the secondary transfer roller 80 described below. The primary transfer roller 60, the drive roller 71 and the driven roller 72 are supported by a base 73.

The secondary transfer roller 80 is a device for transferring monochrome or full color toner images or the like formed on the intermediate transfer belt 70 to a recording medium P such as a paper, a film or a cloth.

The fixing unit 90 is a device for fusion-fixing the toner image to the recording medium P to form a permanent image (printing image) by applying heat and pressure to the recording medium P on which the toner image has been transferred.

The cleaning unit 75 includes a rubber-made cleaning blade 76 which makes contact with the outer peripheral surface of the photosensitive dram 20 between the primary transfer roller 60 and the electrifying unit 30. The cleaning unit 75 is provided for scrapping off any toner that remains on the photosensitive dram 20 by the cleaning blade 76 after the toner image has been transferred onto the intermediate transfer belt 70 by the primary transfer roller 60.

The conveying section 88 is equipped with a pair of conveying rollers 88A and 88B through which is conveyed a recording medium P that has undergone a fixing process on one side thereof by the fixing unit 90, and a conveying route 88C which turns over the recording medium P conveyed by the pair of conveying rollers 88A and 88B and guides it toward registration rollers 86.

In this way, in the case where a printing image is to be formed on both sides of a recording medium P, the recording medium P that has undergone a fixing process on one side thereof by the fixing unit 90 is turned over and returned to the secondary transfer roller 80.

Next, an operation of the image forming apparatus 10 having the above structure will be described.

First, the photosensitive dram 20, the developing rollers (not shown in the drawings) provided in the developing unit 50, and the intermediate transfer belt 70 are started to rotate in accordance with instructions from a host computer not shown in the drawings. Then, the photosensitive dram 20 is sequentially charged by the electrifying unit 30 while rotating.

The charged area of the photosensitive dram 20 reaches the exposure position according to the rotation of the photosensitive dram 20, and at the same time a latent image according to first color (e.g., yellow "Y") image information is formed in the charged area by the exposure unit 40.

The latent image formed on the photosensitive dram 20 reaches the developing position according to the rotation of the photosensitive dram 20, and developing with a yellow toner is carried out by the yellow developing device 54. In this way, a yellow toner image is formed on the photosensitive dram 20. At this time, the yellow developing device 54 of the YMCK developing unit 50 faces the photosensitive dram 20 at the above developing position.

The yellow toner image formed on the photosensitive body 20 reaches a primary transfer position (namely, a position in which the photosensitive dram 20 faces the primary transfer roller 60) according to the rotation of the photosensitive dram 20, and at the same time it is transferred (primarily transferred) to the intermediate transfer belt 70 by the primary transfer roller 60.

At this time, a primary transfer voltage (primary transfer bias) having an opposite polarity as a charge polarity of the toner is applied to the primary transfer roller 60. In this regard, it is to be noted that during this time, the secondary transfer roller 80 is kept separated from the intermediate transfer belt 70.

By repeating the same process described above for the second color, the third color and the fourth color, each color toner image corresponding to each image signal is transferred and layered onto the intermediate transfer belt 70. In this way, a full color toner image is formed on the intermediate transfer belt 70.

On the other hand, the recording medium P is conveyed from the paper supply tray 82 to the secondary transfer roller 80 by a paper supply roller 84 and the registration rollers 86.

The full color toner image formed on the intermediate transfer belt 70 reaches a secondary transfer position (namely, a position in which the secondary transfer roller 80 faces the drive roller 71) according to the rotation of the intermediate transfer belt 70, and is transferred (secondarily transferred) to the recording medium P by the secondary transfer roller 80.

At this time, the secondary transfer roller 80 is pressed against the intermediate transfer belt 70 and a secondary transfer voltage (secondary transfer bias) is applied to the intermediate transfer belt 70.

The full color toner image transferred to the recording medium P is fused to the recording medium P under heat and pressure applied by the fixing unit 90. Then, the recording medium P is ejected to the outside of the image forming apparatus 10 by a pair of paper ejection rollers 87.

On the other hand, after the photosensitive dram 20 passes the primary transfer position, the toner adhering to the outer peripheral surface thereof is scraped off by the cleaning blade 76 of the cleaning unit 75, and then preparation is made for the electrification for forming the next latent image. The scraped off toner is collected in a residue toner collecting portion inside the cleaning unit 75.

In the case where a printing image is to be formed on both sides of a recording medium P, the pair of paper ejection rollers 87 is driven in reverse and the pair of conveying rollers 88A and 88B is driven after the recording medium P which has undergone a fixing process on one side thereof by the fixing unit 90 is held between the pair of paper ejection rollers 87, whereby the recording medium P is turned over as it passes through the conveying section 88 and returned to the secondary transfer roller 80.

Then, by carrying out the same operation described above, a printing image is formed on the other side of the recording medium P.

Developing Device

Now, the developing device 54 which is one example of the developing device of the invention will be described in detail with reference to the accompanying drawings.

In this regard, it is to be noted that since the developing devices 51, 52 and 53 have the same configurations as the developing device 54 except that kinds of toner to be used are different, an explanation of the developing devices 51, 52 and 53 is omitted.

Figure 2:
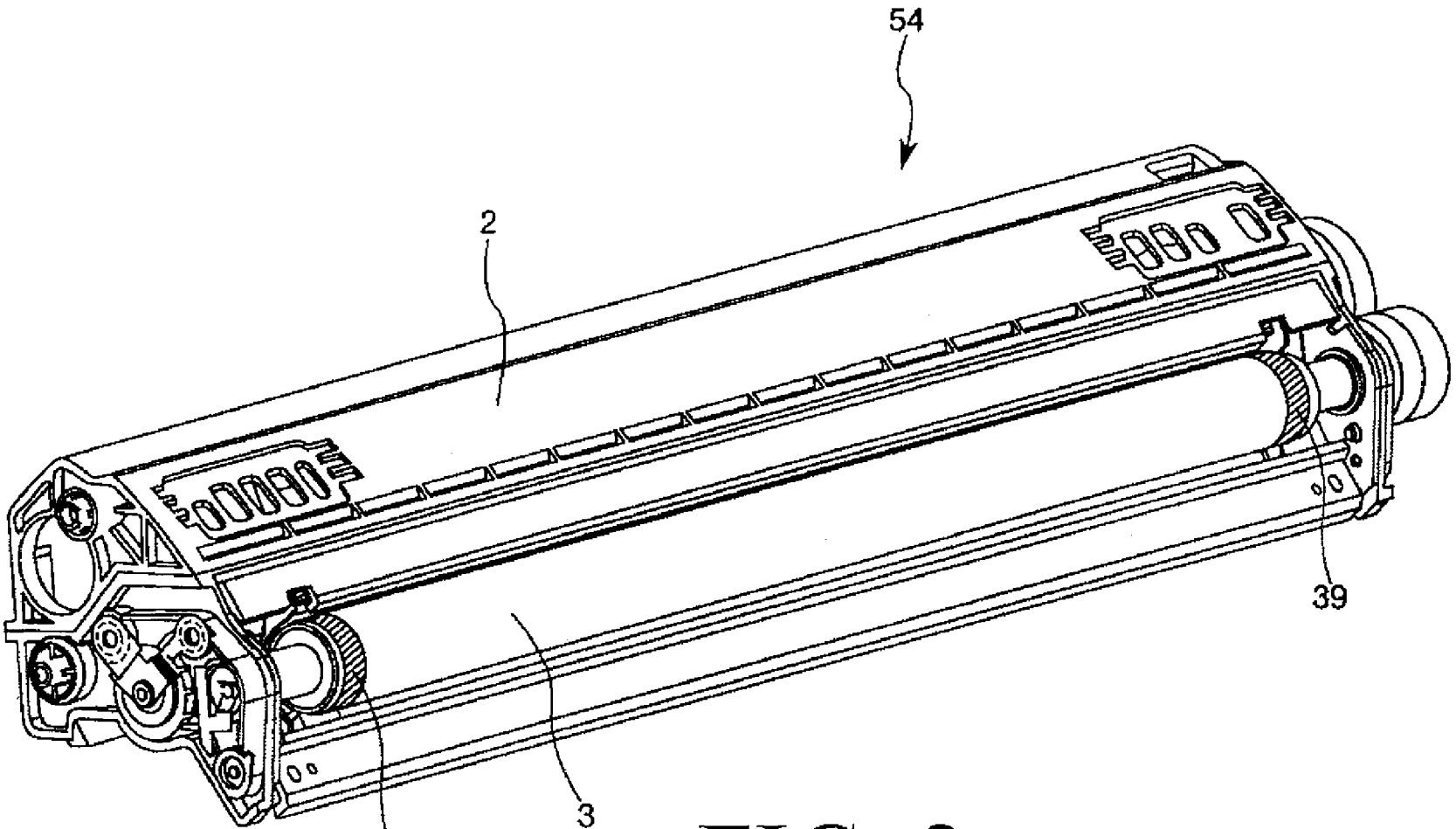
FIG. 2 is a perspective view showing a developing device employed in the image forming apparatus shown in FIG. 1.
Figure 3:
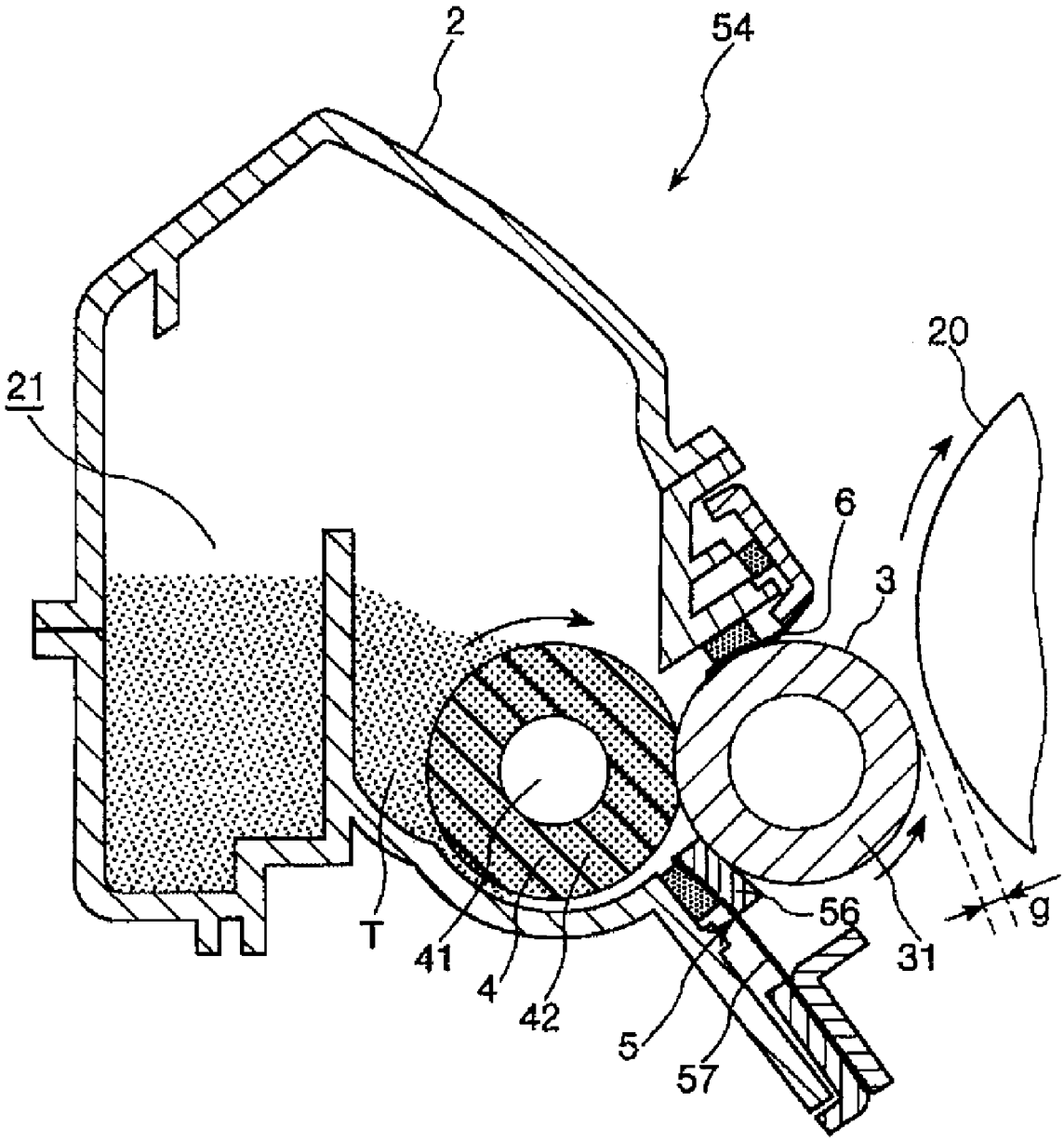
FIG. 3 is a schematic sectional view showing a simplified configuration of the developing device shown in FIG. 2.

FIG. 2 is a perspective view showing a developing device employed in the image forming apparatus shown in FIG. 1. FIG. 3 is a schematic sectional view showing a simplified configuration of the developing device shown in FIG. 2.

As shown in FIG. 3, the developing device 54 includes a housing 2 in which a toner receiving portion 21 for receiving a toner T as a developing agent is formed, a developing roller 3 for carrying the toner T thereon, a toner supply roller 4 for supplying the toner T to the developing roller 3 and a restriction blade 5 for restricting a thickness of a layer to be formed by the toner T carried on the developing roller 3.

Further, the housing 2 is adapted to receive the toner T within the toner receiving portion 21 formed of an internal space thereof.

The toner T is constituted of resin base particles containing a binder resin and a coloring agent, and a small amount of silicone oil and/or fluoro oil added (externally added) to the resin base particles.

In particular, in such a toner T, an average particle size of the resin base particles in volume basis is in the range of 2 to 4 μm, and an added amount of the silicone oil and/or fluoro oil to the resin base particles is in the range of 0.05 to 2 mass %.

In this regard, it is to be noted that the toner T will be described below in detail.

Further, the housing 2 has an opening opened at the right side thereof in FIG. 3. And, the toner supply roller 4 and the developing roller 5 are rotatably supported by the housing 2 in the vicinity of the opening.

Furthermore, the restriction blade 5 is attached to the housing 2. Also attached to the housing 2 is a seal member 6 for preventing the toner T from being leaked from the opening between the housing 2 and the developing roller 3.

The developing roller 3 is adapted to carry the toner T on its outer peripheral surface and convey the toner T to a developing position at which the developing roller 3 faces the photosensitive dram 20 (hereinafter, simply referred to as "developing position").

The developing roller 3 is of a hollow cylindrical shape and is rotatable about an axis thereof. In this embodiment, the developing roller 3 is rotated in an opposite direction to a rotational direction of the photosensitive dram 20.

Further, as shown in FIG. 2, tape type spacers 39 are provided on both end portions of the outer peripheral surface of the developing roller 3 along a circumference thereof, respectively. These spacers 39 are provided in pressure contact with regions of the outer peripheral surface of the photosensitive dram 20 where no latent image and toner image are formed.

In this way, a developing gap "g" is formed between the developing roller 3 and the photosensitive dram 20. A size of the developing gap g can be adjusted to a desired distance by setting a thickness of each spacer 39 to an adequate size.

A constituent material of each spacer 39 is not particularly limited to a specific type, but it is preferred that a material having an elasticity and a hygroscopic property larger than those of the developing roller 3 is used as the constituent material of each spacer 39.

Further, it is preferred that the spacers 39 and the developing roller 3 are fixed via an adhesive having an elasticity. In this regard, it is to be noted that the developing roller 3 will be described below in detail.

In this way, the developing roller 3 and the photosensitive dram 20 are confronted with each other in a non-contact condition with a minute gap (that is, the developing gap g) left therebetween.

By applying an alternating bias (alternating electric field) as a bias voltage between the developing roller 3 and the photosensitive dram 20, the toner T is caused to fly (transfer) from the developing roller 3 onto the photosensitive dram 20, thereby enabling the latent image to be developed to a toner image on the photosensitive dram 20.

Namely, in this embodiment, so-called non-contact jumping development is carried out. In the non-contact jumping development, when an alternating bias (developing bias voltage) is applied between the developing roller 3 and the photosensitive dram 20, reciprocatory flight of the toner T occurs therebetween depending on alteration of the alternating bias.

The toner supply roller 4 supplies the toner T from the toner receiving portion 21 to the developing roller 3. The toner supply roller 4 includes a hollow or solid cylindrical main body 41 having an outer peripheral surface, and an elastic porous layer 42 provided on the outer peripheral surface of the main body 41 and having a plurality of pores.

The elastic porous layer 42 is made of polyurethane foam or the like, and is pressure-contacted with the developing roller 3 in an elastically deformed condition. In this embodiment, the toner supply roller 4 is rotated in an opposite direction to a rotational direction of the developing roller 3.

The toner supply roller 4 performs not only a function of supplying the toner T to the developing roller 3 but also a function of scrapping off the toner T remaining on the surface of the developing roller 3 at the end of the developing operation (development). Also applied to the toner supply roller 4 is a voltage equal to the developing bias voltage to be applied to the developing roller 3.

The restriction blade 5 restricts the thickness of the layer to be formed by the toner T carried on the developing roller 3 and, at the time of performing the restriction operation, applies electric charges to the toner T by frictional electrification. The restriction blade 5 also serves as a seal member for sealing between the housing 2 and the developing roller 3.

The restriction blade 5 includes an elastic body 56 that makes contact with the developing roller 3 along the axial direction thereof, and a support member 57 that supports the elastic body 56. The elastic body 56 is constituted of silicon rubber, urethane rubber or the like as a main component thereof.

On the other hand, the support member 57 is formed of a sheet-like thin plate made of a material having a spring property (resiliency) such as phosphor bronze or stainless steel. This makes it possible for the support member 57 to have a function of pushing the elastic body 56 against the developing roller 3.

In this embodiment, the restriction blade 5 is arranged such that the tip end (free end) thereof can face the upstream side in a rotational direction of the developing roller 3, thereby providing what is a so-called "counter-contact" with the developing roller 3.

Further, in the developing device 54 of this embodiment, a residual toner remaining on the developing roller 3 is dropped downward by the restriction blade 5 so that the dropped toner is returned to the toner receiving portion 21.

Developing Roller

Now, the developing roller 3 which is one example of the developing roller employed in the developing device of the invention will be described in detail with reference to FIGS. 4 to 6.

Figure 4:
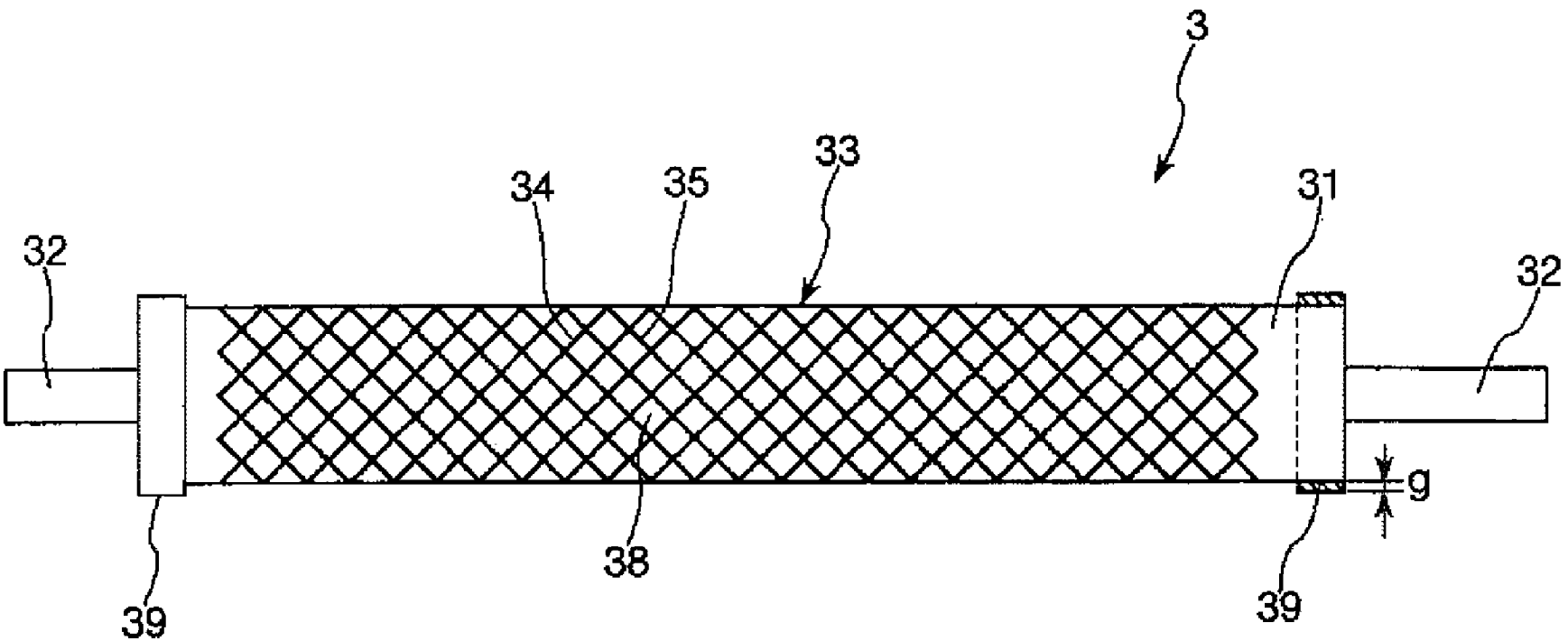
FIG. 4 is a top view showing a simplified configuration of a developing roller employed in the developing device shown in FIGS. 2 and 3.

FIG. 4 is a top view showing a simplified configuration of a developing roller employed in the developing device shown in FIGS. 2 and 3. FIG. 5 is an enlarged view showing the outer peripheral surface of the developing roller shown in FIG. 4. FIG. 6 is a sectional view taken along line A-A in FIG. 5.

The developing roller 3 shown in FIG. 4 includes a hollow or solid cylindrical main body 31, and a pair of shaft portions 32 protruding from both ends of the main body 31 and serving as rotation axes.

As shown in FIG. 4, an irregularity section 33 for carrying the toner T is formed on an outer peripheral surface of the main body 31.

Figure 5:
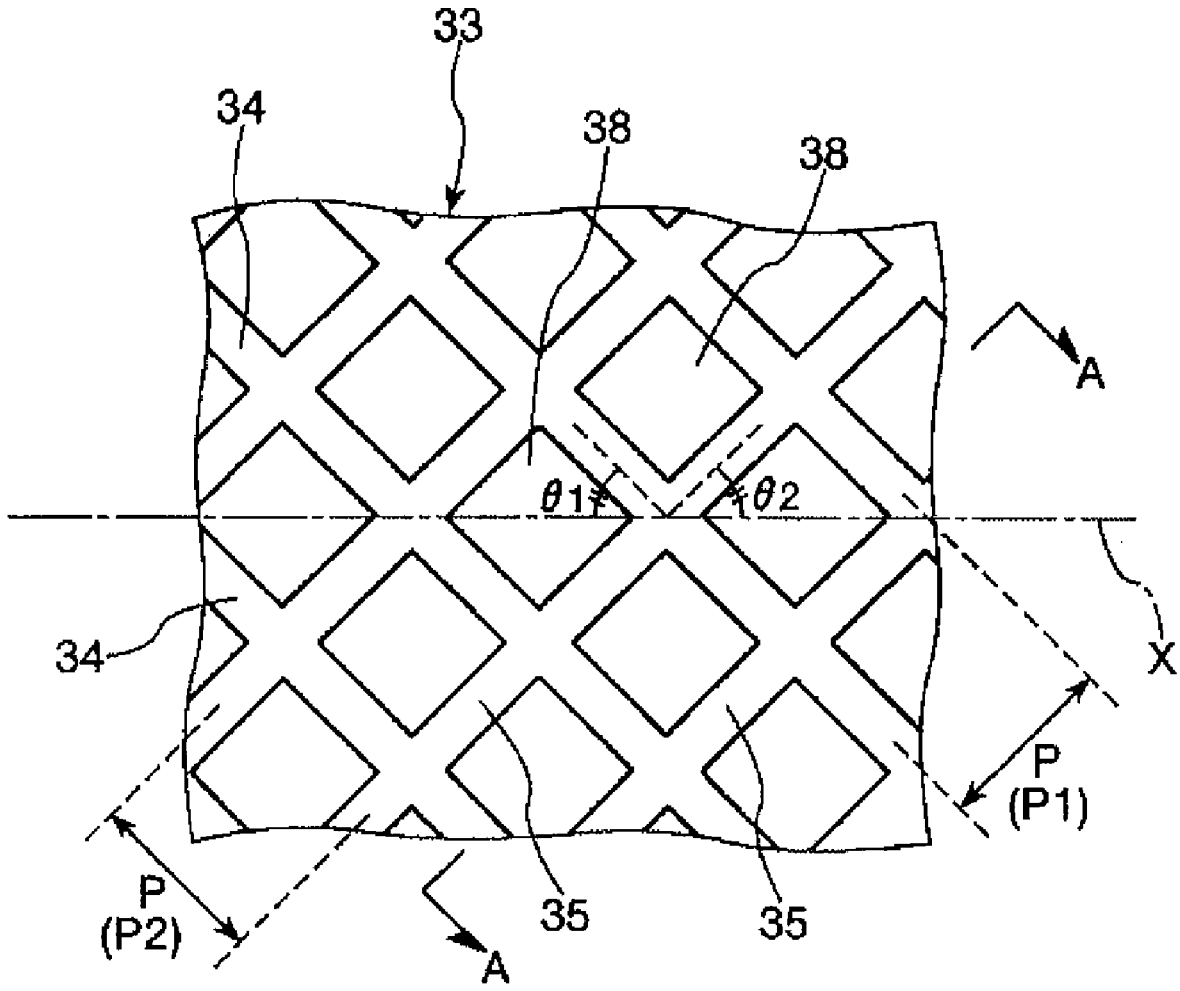
FIG. 5 is an enlarged view showing the outer peripheral surface of the developing roller shown in FIG. 4.

As shown in FIG. 5, the irregularity section 33 includes of a plurality of first grooves 34 extending in a generally parallel relationship with one another and a plurality of second grooves 35 extending in a generally parallel relationship with one another, but intersecting the first grooves 34.

Therefore, in the irregularity section 33 having such a configuration, a protrusion portion (convex portion) 38 is formed in the region enclosed by a pair of mutually adjoining first grooves 34 (depression portions) and a pair of mutually adjoining second grooves 35 (depression portions).

Specifically, as can be seen in FIG. 4, each first groove 34 is formed along the outer peripheral surface of the main body 31 in a spiral manner. In other words, each first groove 34 extends in a direction inclined with respect to a segment parallel to an axis line X of the main body 31 on the outer peripheral surface thereof (that is, in a direction inclined with respect to a circumferential direction of the outer peripheral surface of the main body 31).

Figure 6:
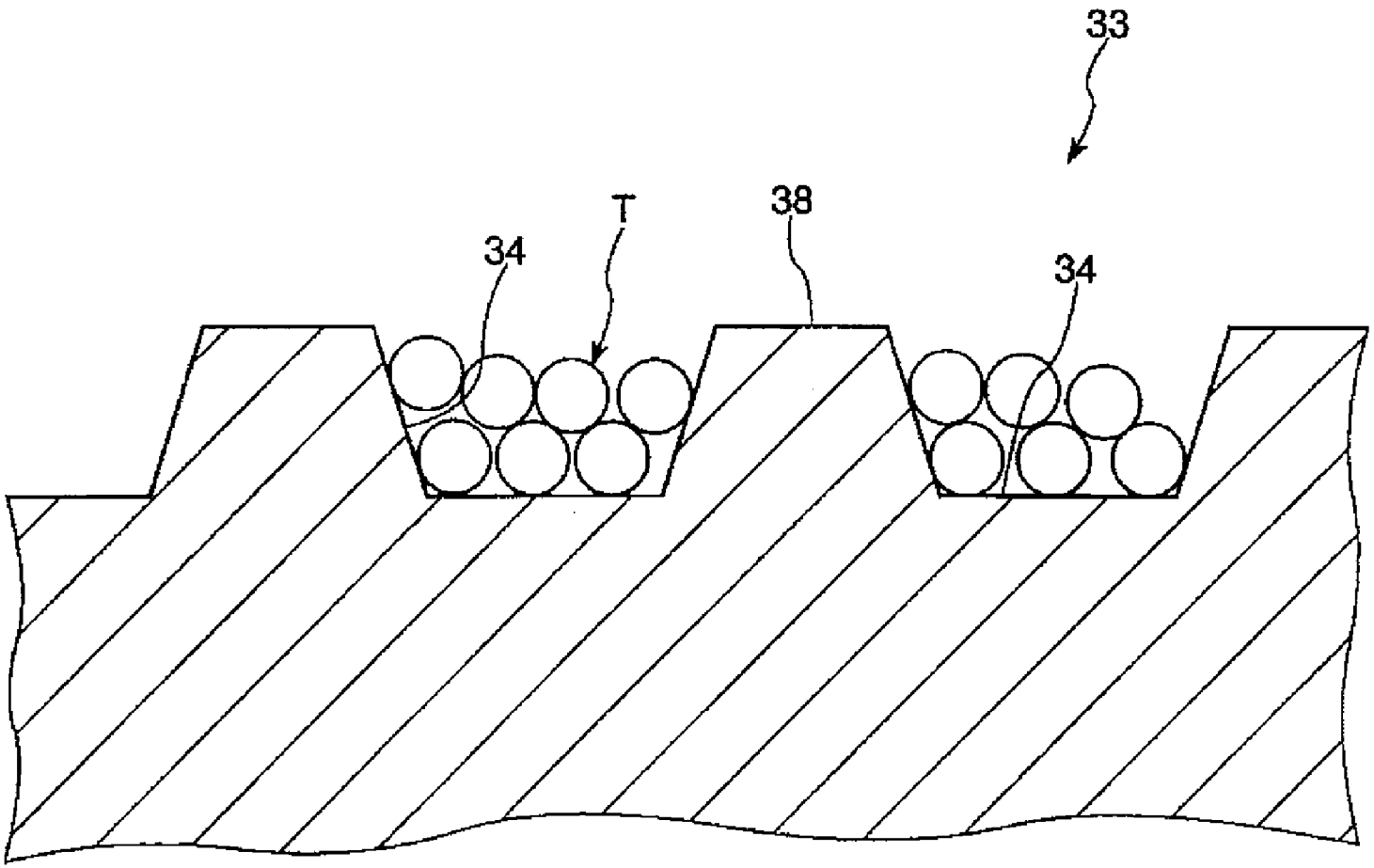
FIG. 6 is a sectional view taken along line A-A in FIG. 5.

Further, as shown in FIG. 6, a cross-sectional shape of each first groove 34 is a trapezoid-shape, but is not limited thereto, may be another shape such as U-shape, V-shape, or the like.

On the other hand, each second groove 35 is formed along the outer peripheral surface of the main body 31 in a spiral manner so as to extend in an opposite direction to each first groove 34 described above. In other words, each second groove 35 extends in a direction inclined with respect to a segment parallel to an axis line X of the main body 31 on the outer peripheral surface thereof (that is, in a direction inclined with respect to a circumferential direction of the outer peripheral surface of the main body 31).

In this regard, it is to be noted that each of the second grooves 35 have the same configuration as that of each of the first grooves 34, except that they extend in a different direction than the first grooves 34 as set forth above.

In this embodiment, a pitch between the first grooves 34 and a pitch between the second grooves 35 are the same. Further, an inclined angle of each of the first grooves 34 with respect to the segment parallel to the axis line X of the main body 31 on the outer peripheral surface thereof is the same as that of each of the second grooves 35.

Namely, as shown in FIG. 5, an inclined angle "θ1" of each of the first grooves 34 with respect to the segment parallel to the axis line X of the main body 31 on the outer peripheral surface thereof and an inclined angle "θ2" of each of the first grooves 35 with respect to the segment parallel to the axis line X of the main body 31 on the outer peripheral surface thereof are the same.

In this way, the irregularity section 33 includes the plurality of the depression portions and/or protrusion portions provided regularly and uniformly.

Although each of the resin base particles constituting the toner T has a small particle size as described above, aggregates, which are formed by aggregation of the resin base particles via the oil, can behave as though they are large particle size toner particles within the toner receiving portion 21 and on the developing roller 3.

Whereas, the aggregates can behave as small particle size toner particles on the photosensitive dram 20 due to crush thereof as described later in detail. In addition, by contact of the aggregates with the irregularity section 33, a particle size of each of the aggregates can be equalized, and the silicone oil and/or fluoro oil can be uniformly dispersed in the toner T.

In particular, between the developing roller 3 and the toner supply roller 4 and between the developing roller 3 and the restriction blade 5, by contact of the aggregates with the irregularity section 33, particle sizes of the aggregates can bed equalized more reliably, and the silicone oil and/or fluoro oil can be uniformly dispersed in the toner T more reliably.

Therefore, a printing image having high resolution and a high quality level can be formed, while resolving various problems resulted from the use of the small particle size toner particles.

Further, by forming the irregularity section 33 from the plurality of the first grooves 34 and the plurality of the second grooves 35, the depression portions and/or protrusion portions can be provided regularly in spite of a relatively simple structure.

Furthermore, by using a die rolling method, the irregularity section 33, in which the depression portions and/or protrusion portions are provided regularly, can be formed relatively simply and reliably.

Since the irregularity section 33 is formed regularly and uniformly, a uniform and optimal quantity of the toner T can be carried on the developing roller 3 and a tumbling capability (that is, ease of tumbling movement) of the toner T on the outer peripheral surface of the developing roller 3 can be made uniform.

As a result, it is possible to avoid a local poor electrification or a local poor conveyance of the toner T, thereby allowing the developing roller 3 to exhibit an excellent developing characteristic.

Unlike the irregularities formed by a blast treatment, the irregularity section 33 exhibits an excellent mechanical strength because the protrusion portions 38 of the irregularity section 33 are provided with tip ends each having a relatively large width.

In particular, since the irregularity section 33 is formed by a treatment such as a die transfer (die rolling), the pressed region has an excellent mechanical strength and the thus formed irregularity section 33 shows a greater mechanical strength than one formed by another treatment such as a cutting work.

The developing roller 3 having such an irregularity section 33 can exhibit an excellent durability even when it makes sliding contact with the restriction blade 5, the toner supply roller 4 and the like. Therefore, the developing roller 3 can be preferably used in the developing device that uses a dry monocomponent nonmagnetic toner.

In addition, as described above, if the protrusion portions 38 of the irregularity section 33 are provided with tip ends each having a relatively large width, they undergo a little change in a shape even when worn out. This helps to prevent a rapid degradation of developing characteristic and makes it possible for the developing roller 3 to exhibit an excellent developing characteristic for a prolonged period of time.

Further, since each first groove 34 and each second groove 35 extend in a direction inclined with respect to a circumferential direction of the outer peripheral surface of the main body 31, respectively, when the developing roller 3 is rotated, the toner T carried on the irregularity section 33 is conveyed while being moved toward both ends of the main body 31.

Therefore, it is possible to prevent the toner T from being unevenly distributed on one end side of the main body 31 in an axis line X direction thereof. In other words, particle sizes of the aggregates of the resin base particles and dispersion of the silicone oil and/or fluoro oil in the toner T can be equalized in the axis line X direction of the main body 31. As a result, an image quality of a printing image can be further improved.

The main body 31 of such a developing roller 3 is made of a metallic material such as aluminum, stainless steel, iron, or the like as a main component thereof. In particular, as for the constituent material of the main body 31, iron-based materials such as STK and SGP, aluminum-based materials such as A6063 and A5056, and the like are preferably used.

In this regard, it is to be noted that the outer peripheral surface of the main body 31 may be plated with nickel, chromium, or the like, if needed.

Further, an outer diameter of the main body 31 is not particularly limited to a specific value, but is preferably in the range of about 10 to 30 mm, and more preferably in the range of about 15 to 20 mm.

Furthermore, it is preferred that a pitch "P1" between the first grooves 34 and a pitch "P2" between the second grooves 35 are respectively smaller than an average size of the pores in the elastic porous layer 42 of the toner supply roller 4.

This makes it possible to flake the aggregates of the resin base particles existing within the pores of the elastic porous layer 42 of the toner supply roller 4 due to contact with the irregularity section 33. As a result, the silicone oil and/or fluoro oil can be dispersed in the toner T more uniformly.

Specifically, the pitch P1 between the first grooves 34 and the pitch P2 between the second grooves 35 are not particularly limited to a specific value, but are preferably in the range of about 50 to 150 μm, and more preferably in the range of about 50 to 100 μm.

Further, in the case where the pitch between the first grooves 34 and the pitch between the second grooves 35 are defined as "P", the P is preferably smaller than a pitch of resolution to be employed (that is, a pitch between dots constituting a printing image formed under the employed resolution).

More specifically, the P is preferably smaller than 169 μm in the case of the resolution being 150 dpi, smaller than 127 μm in the case of the resolution being 200 dpi, and smaller than 85 μm in the case of the resolution being 300 dpi. This makes it possible to prevent a toner image obtained by development from becoming uneven.

Further, a depth of each first groove 34 and/or each second groove 35, that is, a depth of each depression portion of the irregularity section 33 is larger than the average particle size of the resin base particles in volume basis contained in the toner T.

This makes it possible to adjust the particle size of each of the aggregates of the resin base particles to a value corresponding to the depth of each depression portion of the irregularity section 33 by making the aggregates contact with the irregularity section 33.

As a result, it is possible to allow the resin base particles to exist as the aggregate on the developing roller 3 more reliably, thereby preventing a toner fly (dispersal of the resin base particles) more reliably.

Furthermore, it is preferred that the depth of each first groove 34 and each second groove 35 is equal to or smaller than 2 times the average particle size of the resin base particles in volume basis contained in the toner T. This makes it possible to optimize the particle size of each of the aggregates, and therefore a charge property of each of the resin base particles can be improved while preventing the toner fly.

Specifically, in the case where an average depth of the first grooves 34 and the second grooves. 35 is defined as "D" and an average particle size of the resin base particles contained in the toner T (developing agent) is defined as "d", D/d is preferably in the range of 0.5 to 2, and more preferably in the range of 0.9 to 1.3. This makes it possible for the developing roller 3 to carry the toner T on the irregularity section 33 in an uniform and optimal quantity.

In contrast, if the D/d is smaller than the lower limit value, the toner T is hard to be caught by the protrusion portions 38 of the irregularity section 33 depending on a shape of the irregularity section 33 or other conditions. As a result, a tumbling capability of the toner T is lowered and a poor electrification of the resin base particles is likely to occur.

On the other hand, if the D/d exceeds the upper limit value, there is a case that the toner T in the grooves 34 and 35 (depression portions of the irregularity section 33) fails to make contact with both of the developing roller 3 and the restriction blade 5 depending on a shape of the irregularity section 33 or other conditions, thus leading to a poor electrification of the resin base particles.

Further, in the case where an average width of the first grooves 34 and the second grooves 35 is defined as "W" and an average particle size of the resin base particles contained in the toner T (developing agent) is defined as "d", W/d is preferably, in the range of 2 to 20, and more preferably in the range of 4 to 10. This makes it possible for the developing roller 3 to carry the toner T (developing agent) on the irregularity section 33 in a uniform and optimal quantity.

In contrast, if the W/d is smaller than the lower limit value, the toner T fails to move into the grooves 34 and 35 depending on a shape of the irregularity section 33 or other conditions. As a result, a tumbling capability of the toner T is lowered and a poor electrification of the resin base particles is likely to occur. Further, even when the toner T is entered into the grooves 34 and 35, it continues to stay in the grooves 34 and 35 and tends to cause a filming phenomenon.

On the other hand, if the W/d exceeds the upper limit value, there is a case that, depending on a shape of the irregularity section 33 or other conditions, a quantity of the toner T carried on the developing roller 3 is decreased to such an extent as to bring about a poor conveyance of the toner T. As a result, an opportunity for the toner T to make contact with the protrusion portions 38 of the irregularity section 33 is reduced, thereby resulting in a lowered tumbling capability of the toner T and a poor electrification of the resin base particles.

In this regard, it is to be noted that the width "W1" of each first groove 34 and the width "W2" of each second groove 35 may be the same or different.

Toner

The toner T to be used for the above described image forming apparatus 10 is constituted of resin base particles containing a coloring agent and a binder resin, and silicone oil and/or fluoro oil added (externally added) to the resin base particles. In particular, in such a toner T, an average particle size of the resin base particles in volume basis is in the range of 2 to 4 μm, and an added amount of the silicone oil and/or fluoro oil to the resin base particles is in the range of 0.05 to 2 mass %.

In such a toner T, although each of the resin base particles has a small particle size as described above, since at least one of the silicone oil and the fluoro oil is externally added thereto, aggregates are formed as secondary particles by aggregation of the resin base particles due to a liquid bridge force of the silicone oil and/or fluoro oil.

These aggregates can behave as though they are large particle size toner particles within the toner receiving portion 21 and on the developing roller 3. This makes it possible to prevent a toner fly and to improve a conveyance efficiency of the toner T.

In addition, by setting the added amount of the silicone oil and/or fluoro oil to the resin base particles to the range of 0.05 to 2 mass %, the liquid bridge force of the silicone oil and/or fluoro oil can be optimized. This makes it possible to maintain a flowability of the toner T required for charging the resin base particles, and to obtain the aggregates as soft aggregates by aggregation of the resin base particles softly.

As a result, the aggregates (soft aggregates) can be crushed easily by their reciprocal motion between the developing roller 3 and the photosensitive dram 20 during the non-contact jumping development as described above. Therefore, the crushed aggregates can behave as though they are small particle size toner particles on the photosensitive dram 20 reliably, as a result of which resolution and a gradient of a printing image can be improved.

Resin Base Particles

The resin base particles contain a coloring agent and a binder resin. The binder resin is not particularly limited to a specific type, but polyester resins such as cross-link type polyester resin and straight chain type polyester resin are preferably used as the binder resin. On the other hand, the coloring agent is not also particularly limited to a specific type, but various kinds of pigments, various kinds of dyes and the like are preferably used as the coloring agent.

A content of the coloring agent to the resin base particles is not particularly limited to a specific value, but is preferably in the range of 10 to 20 mass %. Further, it is preferred that such resin base particles contain wax in addition to the coloring agent and binder resin described above. In this regard, it is to be noted that the resin base particles may contain components other than the components described above.

Further, the average particle size of the resin base particles in volume basis is in the range of 2 to 4 μm. By setting the average particle size of the resin base particles to a size smaller than 4 μm, that is, by forming each of the resin base particles so as to have a small particle size, resolution and a gradient of a printing image can be improved.

Further, by using such resin base particles each having a small particle size, since a thickness of a toner layer constituting a printing image can be made thin, it is possible to suppress a necessary heat quantity and toner consumption during a fixing step.

In contrast, if the average particle size of the resin base particles is smaller than 2 μm, since it is required that the resin base particles contain the coloring agent in an amount equal to or larger than 20 mass %, there is a fear that a fixing property of the toner T (resin base particles) is severely lowered due to the small amount of the binder resin.

Further, in the case where the average particle size of the resin base particles in volume basis (that is, a mean volume diameter of the resin base particles) is defined as "Dv" and an average particle size of the resin base particles in number basis (that is, a mean number diameter of the resin base particles) is defined as "Dn", Dv/Dn is preferably in the range of 1 to 1.1.

This makes it possible to obtain aggregates (soft aggregates) in which gaps having adequate distances are formed between the resin base particles. In such aggregates, the resin base particles are aggregated softly due to the liquid bridge force of the silicone oil and/or fluoro oil.

Although since such aggregates are difficult to be crushed within the toner receiving portion 21 and on the developing roller 3, they can behave as though they are large particle size toner particles, whereas the aggregates can be crushed easily by their reciprocal motion between the developing roller 3 and the photosensitive dram 20 during the non-contact jumping development as described above.

Therefore, the aggregates can behave as though they are small particle size toner particles on the photosensitive dram 20 reliably. As a result, resolution and a gradient of a printing image can be further improved.

In contrast, if the Dv/Dn is lower than 1 or exceeds 1.1, aggregates are likely to be formed so that small particle size resin base particles are penetrated between large particle size resin base particles. Since such aggregates can have only small gaps formed between the small and large resin base particles inside thereof, the resin base particles are strongly aggregated due to the liquid bridge force of the silicone oil and/or fluoro oil.

Therefore, the aggregates cannot be crushed even by their reciprocal motion between the developing roller 3 and the photosensitive dram 20 during the non-contact jumping development described above. As a result, resolution and a gradient of a printing image cannot be improved.

Further, as described above, if the Dv/Dn is set to the above range of 1 to 1.1 in the case of single use of the resin base particles, a bulk density of the Toner T cannot exceed 0.25 g/cm$^3$. However, by adding the silicone oil and/or fluoro oil to the resin base particles, a bulk density of the toner T can be set to a value equal to or higher than 0.25 g/cm$^3$.

Furthermore, an upper limit value of the bulk density of the toner T is not particularly limited to a specific value, but is preferably lower than 0.35 g/cm$^3$. If the upper limit value of the bulk density of the toner T exceeds 0.35 g/cm$^3$, since gaps to be formed between the resin base particles become small, there is a fear that aggregates, in which the resin base particles are strongly aggregated due to the liquid bridge force of the silicone oil and/or fluoro oil, are formed.

Therefore, the aggregates cannot be crushed even between the developing roller 3 and the photosensitive dram 20 during the non-contact jumping development described above. As a result, resolution and a gradient of a printing image cannot be improved.

Silicone Oil and Fluoro Oil

Silicone oil contained in the toner T is not limited to a specific type. Examples of the silicone oil include dimethylsilicone oil, hydrogensilicone oil, phenylsilicone oil, aminosilicone oil, epoxysilicone oil, carboxysilicone oil, polyethersilicone oil, hydrophilic silicone oil, methacrylsilicone oil, mercaptosilicone oil, silicone oil having a reactive group at one end thereof, higher alkoxy silicone oil, alkylsilicone oil, and the like.

Among these silicone oils, it is preferred that the dimethylsilicone oil is used as the silicone oil contained in the toner T. The dimethylsilicone oil is a harmless to humans, and has an excellent lubricity, chemical stability and thermal stability. Namely, the dimethylsilicone oil can be preferably used as an additive agent for the toner T having an excellent safety and stability.

Further, it is preferred that a kinetic viscosity at 25° C. of the dimethylsilicone oil (hereinbelow, also simply referred to as "kinetic viscosity") is in the range of 50 to 300 mm$^2$/s, This makes it possible to obtain a toner T which can exhibit an excellent developing characteristic stably.

In contrast, if the kinetic viscosity is smaller than 50 mm$^2$/s, the dimethylsilicone oil vaporizes easily. As a result, there is a fear that a physicality of the toner T is changed, and therefore a developing characteristic of the toner T is changed.

In particular, since a contact area of the dimethylsilicone oil to the air becomes large in a state that it is carried on the resin base particles (toner particles), and a temperature inside of an image forming apparatus (specifically, a temperature in the vicinity of a developing device) is set to a high temperature, there is a fear that the dimethylsilicone oil is vaporized as compared with a normal state more easily.

On the other hand, if the kinetic viscosity exceeds 300 mm$^2$/s, when the dimethylsilicone oil is added into the toner T, the resin base particles are aggregated needlessly so that aggregates having an oversized particle size are formed. Such aggregates induce poor development, as a result of which this poor development becomes a cause for generating an uneven printing image.

Fluoro oil contained in the toner T is not limited to a specific type, for example, perfluoropolyether, polytrifluoroethylene chloride, and the like can be preferably used.

In particular, it is preferred that the added amount of the silicone oil and/or fluoro oil to the resin base particles is in the range of 0.05 to 2 mass %. By adjusting the added amount to a value within the above range, since the resin base particles are wetted adequately, a toner fly can be prevented.

Further, by adjusting the added amount to a value within the above range, during the above described non-contact jumping development is carried out, the aggregates can be crushed easily by their reciprocal motion between the developing roller 3 and the photosensitive dram 20.

In contrast, if the added amount of the silicone oil and/or fluoro oil to the resin base particles is smaller than 0.05 mass %, it becomes difficult for the resin base particles to be aggregated softly with each other. This makes it difficult to obtain aggregates (secondary particles) in which the resin base particles are aggregated softly.

On the other hand, if the added amount of the silicone oil and/or fluoro oil to the resin base particles exceeds 2 mass %, the resin base particles are aggregated strongly. As a result, during the above described non-contact jumping development is carried out, the obtained aggregates (secondary particles) cannot be crushed even if they are reciprocally moved between the developing roller 3 and the photosensitive dram 20. This makes it impossible to improve resolution and a gradient of the printing image.

Further, the toner T may contain fine particles such as silica particles, titania particles, and particles obtained by subjecting them to a hydrophobic treatment as an externally added agent. By adding these particles into the toner T, properties of the toner T such as a flowability and a electrostatic property can be adjusted.

Such a toner T can be produced by the following method.

Such a method for producing the toner T comprises: a first step (that is, a coloring resin liquid preparing step) of dissolving or dispersing a binder resin, a coloring agent and wax into an organic solvent to obtain a coloring resin liquid; a second step (that is, an emulsifying step) of adding a basic compound and water into the coloring resin liquid in the named order to obtain an emulsification suspension in which the coloring resin liquid is emulsified into an aqueous medium in the form of oil droplets; a third step (that is, an aggregating step) of adding an electrolyte into the emulsification suspension to obtain aggregated oil droplets by aggregation of the oil droplets of the coloring resin liquid (that is, oil droplets of a dispersoid) contained in the emulsification suspension; a fourth step (that is, an separating and drying step) of removing the organic solvent from the aggregated oil droplets, separating them from the aqueous medium, and then washing and drying them to obtain resin base particles; and a fifth step (that is, an externally adding step) of adding an externally added agent such as silica fine particles, and silicone oil and/or fluoro oil to the obtained resin base particles.

Hereinbelow, these steps will be described in detail sequentially.

First Step

In this step (coloring resin liquid preparing step), first, a binder resin, a coloring agent and wax are added into an organic solvent, and they are dissolved or dispersed in the organic solvent to thereby obtain a coloring resin liquid.

In the case where the binder resin, the coloring agent and the wax are dissolved or dispersed in the organic solvent, it is preferred that a high speed stirrer is used. In this case, a master kneading chip in which the coloring agent is dispersed into the binder resin in advance can be used.

Further, it is also possible to use a master kneading chip in which the wax is dispersed into the binder resin in advance, or a wax master solution in which the wax is finely dispersed into the organic solvent using a media (beads) so as to form particles thereof having a particle size smaller than that of resin base particles to be obtained.

Examples of the high speed stirrer to be used in the coloring resin liquid preparing step include Despa (produced by Asada Iron Works. Co., Ltd.), T.K. Homo Mixer (produced by Primix Corporation), and the like. In the case where such a high speed stirrer is used, a blade tip speed is preferably in the range of 4 to 30 m/s, and more preferably in the range of 8 to 25 m/s.

By using such a stirrer, the binder resin can be dissolved into the organic solvent efficiently, and the coloring agent can be finely and uniformly dispersed in a binder resin solution obtained by dissolving the binder resin into the organic solvent so that the coloring resin liquid can be obtained.

In particular, by adding the above described master kneading chip containing the coloring agent in a fine dispersion state into the organic solvent, and then stirring the organic solvent at a high speed, the coloring agent can maintain the fine dispersion state in the obtained binder resin solution as well as in the master kneading chip.

In contrast, if the blade tip speed is lower than the lower limit value, there is a case that the coloring agent cannot be finely dispersed into the binder resin solution sufficiently depending on kinds of the organic solvent, the coloring agent and the like.

On the other hand, if the blade tip speed exceeds the upper limit value, exothermic heat due to shear becomes large. As a result, there is a case that the organic solvent is vaporized from the binder resin solution, and therefore it becomes difficult to stir the binder resin solution uniformly.

Further, in the coloring resin liquid preparing step, a processing temperature is not particularly limited to a specific value, but is preferably in the range of 20 to 60 Cc, and more preferably in the range of 30 to 50° C. A solubility of the organic solvent to water at 25° C. is not also particularly limited to a specific value, but is preferably in the range of 0.1 to 30 mass %, and more preferably in the range of 0.1 to 25 mass %.

In general, at a normal pressure, a boiling point of the organic solvent is lower than that of water. Therefore, examples of the organic solvent having the above solubility include ketones such as methylethylketone and methylisopropylketone, esters such as ethyl acetate and isopropyl acetate, and the like. Two or more of these organic solvents may be used in combination.

However, from a viewpoint of improvement of a recovery efficiency thereof, it is preferred that any one of the organic solvents is used singly. Further, it is preferred that the organic solvent is a low-boiling organic solvent which can dissolve the binder resin easily and be removed from the coloring resin liquid effectively in the subsequent step.

Further, in the coloring resin liquid preparing step, an emulsifying agent may be added into the organic solvent in addition to the binder resin, the coloring agent and the wax. In order to allow the emulsifying agent to function in an aggregating step described below, it is required that the emulsifying agent has a property that can maintain a dispersion stability in the presence of an electrolyte which will be added in the subsequent step.

Examples of the emulsifying agent having such a property include: nonion type emulsifying agents such as polyoxyethylenenonylphenylether, polyoxyethyleneoctylphenylether, polyoxyethylenedodecylphenylether, polyoxyethylenealkylether, polyoxyethylene fatty acid ester, sorbitan fatty acid ester, polyoxyethylene sorbitan fatty acid ester and various kinds of pluronic-based emulsifying agents; anion type emulsifying agents such as alkyl sulfuric acid ester salt type emulsifying agent and alkyl sulfonic acid salt type emulsifying agent; quaternary ammonium salt type cation type emulsifying agent; alkyl benzene sulfonic acid salt type emulsifying agent; straight chain alkyl benzene sulfonic acid salt type emulsifying agent; and the like.

Further, any one of these emulsifying agents may be used singly, or two or more of these emulsifying agents may be used in combination. By adding an electrolyte into the coloring resin liquid in the presence of such emulsifying agents in an aggregating step described below, it is possible to prevent oil droplets of a coloring resin liquid (oil droplets of a dispersoid) from aggregating ununiformly. This makes it possible to obtain resin base particles having adequate particle size distribution.

An amount of the emulsifying agent to be used to a solid content is preferably in the range of 0.1 to 3.0 mass %, more preferably in the range of 0.3 to 2.0 mass %, and even more preferably in the range of 0.3 to 1.5 mass %.

If the amount of the emulsifying agent to be used to a solid content is smaller than the lower limit value, there is a case that a desired effect for preventing generation of coarse particles cannot be obtained depending on kinds of the emulsifying agents to be used.

On the other hand, if the amount of the emulsifying agent to be used to a solid content exceeds the upper limit value, there is a case that even in the case where an amount of the electrolyte is increased, aggregation of the oil droplets of the coloring resin liquid is not sufficiently progressed in the emulsification suspension depending on kinds of the emulsifying agents to be used. As a result, there is a fear that resin base particles having a desired particle-size cannot be obtained and a yield thereof is lowered due to remaining of fine particles.

As described above, the binder resin is not particularly limited to a specific type, but polyester resins such as cross-link type polyester resin and straight chain type polyester resin are preferably used as the binder resin. As such polyester resins, a polyester resin having an acid number of the range of 3 to 30 KOHmg/g is preferably used, and polyester resin having an acid number of the range of 5 to 20 KOHmg/g is more preferably used.

The polyester resin having an acid number of the range of 3 to 30 KOHmg/g is changed into an anion type by neutralizing of carboxyl groups thereof by a basic compound. Therefore, since hydrophilicity of the binder resin (polyester resin) is improved, it is possible to obtain a coloring resin liquid in which the binder resin is dissolved or dispersed stably.

In contrast, if the acid number of the polyester resin is lower than 3 KOHmg/g, there is a fear that it becomes difficult to produce the resin base particles. On the other hand, if the acid number of the polyester resin exceeds 30 KOHmg/g, there is a fear that it becomes difficult to stabilize a charging amount of resin base particles contained in a toner T to be obtained under an use environment thereof.

Such a polyester resin can be obtained as follows.

The cross-link type polyester resin can be synthesized (manufactured) by reacting bivalent basic acid or derivative thereof, bivalent alcohol and a polyvalent compound (cross-linking agent). Further, the straight chain type polyester resin can be synthesized (manufactured) by reacting bivalent basic acid and bivalent alcohol.

In the case where the cross-link type polyester resin and straight chain type polyester are synthesized, phthalic anhydride, terephthalic acid, isophthalic acid, orthophthalic acid, adipic acid, maleic acid, maleic anhydride, fumaric acid, itaconic acid, citraconic acid, hexahydrophthalic anhydride, tetrahydrophthalic anhydride, cyclohexane dicarboxylic acid, succinic acid, malonic acid, glutaric acid, azelaic acid, sebacic acid, and the like can be used as the bivalent basic acid.

Further, in the case where the cross-link type polyester resin is synthesized, bivalent aliphatic alcohol are preferably used as the bivalent alcohol. Polyester resin synthesized using the bivalent aliphatic alcohol has a high compatibility for the wax, and a toner T (developing agent) including resin base particles produced by using such a polyester resin as the binder resin, has an excellent anti-offset property.

Furthermore, use of the bivalent aliphatic alcohol makes it possible to soften a main chain of the synthesized polyester resin. As a result, a toner T to be obtained can exhibit an improved fixing property at a low temperature.

Examples of the bivalent aliphatic alcohol include 1,4-cyclohexanedimethanol, ethylene glycol, diethylene glycol, propylene glycol, triethylene glycol, dipropylene glycol, tripropylene glycol, neopenthyl glycol, buthanediol, penthanediol, hexanediol, polyethylene glycol, polypropylene glycol, ethyleneoxide-propyleneoxide randomcopolymer diol, ethyleneoxide-propyleneoxide blockcopolymer diol, ethyleneoxide-tetrahydrofrane copolymer diol, polycaprolacton diol, an the like.

Further, in the case where the cross-link type polyester resin is synthesized, it is preferred that a polyvalent epoxy compound is used as the polyvalent compound (cross-linking agent).

Examples of the polyvalent epoxy compound include bisphenol A type epoxy resin, bisphenol F type epoxy resin, bisphenol S type epoxy resin, ethylene glycol diglycidyl ether, hydroquinone diglycidyl ether, N,N-diglycidyl aniline, glycerin triglycidyl ether, trimethylolpropane triglycidyl ether, trimethylolethane triglycidyl ether, pentaerythritol tetraglycidyl ether, 1,1,2,2-tetrakis(p-hydroxyphenyl)-ethane tetraglycidyl ether, cresol novolak type epoxy resin, phenol novolak type epoxy resin, a polymer of a vinyl compound having an epoxy group, an epoxidated resorcinol-acetone condensation product, partially epoxidated polybutadiene, semi-dry or dry fatty acid ester epoxy compound, and the like.

Among the above compounds, the bisphenol A type epoxy resin, the bisphenol F type epoxy resin, the bisphenol S type epoxy resin, the cresol novolak type epoxy resin, the phenol novolak type epoxy resin, the glycerin triglycidyl ether, the trimethylolpropane triglycidyl ether, the trimethylolethane triglycidyl ether, and the pentaerythritol tetraglycidyl ether are preferably used as the polyvalent epoxy compound.

More specifically, examples of the bisphenol A type epoxy resin include Epiclon 850, Epiclon 1050, Epiclon 2055 and Epiclon 3050 each produced by Dainippon Ink and Chemicals, Inc., and the like. Examples of the bisphenol F type epoxy resin include Epiclon 830 and Epiclon 520 each produced by Dainippon Ink and Chemicals, Inc., and the like.

Examples of the orthocresol novolak type epoxy resin include Epiclon N-660, N-665, N-667, N-670, N-673, N-680, N-690 and N-695 each produced by Dainippon Ink and Chemicals, Inc., and the like. Examples of the phenol novolak type epoxy resin include Epiclon N-740, N-770, N-775 and N-865 each produced by Dainippon Ink and Chemicals, Inc., and the like.

Examples of the polymer of a vinyl compound having an epoxy group include a glycidyl (meth)acrylate homopolymer, a glycidyl (meth)acrylate-acryl copolymer, a glycidyl (meth) acrylate-styrene copolymer, and the like. Further, any one of the above described polyvalent epoxy compounds may be used singly, or two or more of the above described polyvalent epoxy compounds may be used in combination.

In the case where the polyvalent epoxy compound is used, a monoepoxy compound may be used in combination as a denaturating agent for the polyester resin (binder resin). Use of the monoepoxy compound in combination makes it possible for the toner T to have an improved fixing property and anti-offset property at a high temperature.

Examples of the monoepoxy compound include phenyl glycidyl ether, alkyl phenyl glycidyl ether, alkyl glycidyl ether, alkyl glycidyl ester, glycidyl ether of alkylphenol alkyleneoxide adduct, α-olefinoxide, monoepoxy fatty acid alkylester. Among the above monoepoxy compounds, the alkyl glycidyl ester is preferably used as the monoepoxy compound. Examples of the alkyl glycidyl ester include Cardura E which is neodecanic acid glycidyl ester (produced by Shell Chemicals Japan Ltd.), and the like.

The cross-link type polyester resin and the straight chain type polyester resin can be synthesized by reacting the above source materials through a dehydration condensation reaction or an ester exchange reaction. Although a reaction temperature and a reaction time are not particularly limited to specific values, respectively, the reaction is normally carried out at 150 to 300° C. for 2 to 24 hours.

Further, the reaction may be carried out in the presence of a catalyst (using a catalyst). Examples of such a catalyst include tetrabuthyl titanate, zinc oxide, tin protoxide, dibuthyltin oxide, dibuthyltin dilaurate, paratoluene sulfonic acid, and the like.

In the case where a mixture of the cross-link type polyester resin and the straight chain type polyester resin is used as the binder resin, a mixing ratio of (a mass of the cross-link type polyester resin)/(a mass of the straight chain type polyester resin) is not particularly limited to a specific value, but is preferably in the range of 5/95 to 60/40, more preferably in the range of 10/90 to 40/60, and even more preferably in the range of 20/80 to 40/60.

If the mixing ratio of (a mass of the cross-link type polyester resin)/(a mass of the straight chain type polyester resin) is smaller than 5/95, there is a case that an anti-hot offset property of the toner T, an aggregating rate in an aggregating step described below, and a dispersibility of additive agents such as the wax and the coloring agent within the resin base particles are decreased.

On the other hand, if the mixing ratio of (a mass of the cross-link type polyester resin)/(a mass of the straight chain type polyester resin) exceeds 60/40, there is a case that a melt viscosity at a T1/2 temperature of the resin base particles is raised, while a fixing property of the toner T at a low temperature is decreased.

A glass-transition temperature (Tg) of the cross-link type polyester resin is not particularly limited to a specific value, but is preferably in the range of 40 to 85° C., and more preferably in the range of 60 to 80° C.

If the glass-transition temperature (Tg) of the cross-link type polyester resin is lower than 40° C., there is a case that a blocking phenomenon (heat aggregation) of the resin base particles is likely to occur during storage or conveyance of the toner T, or when it is subjected to a high temperature in the developing device.

On the other hand, if the glass-transition temperature (Tg) of the cross-link type polyester resin exceeds 85° C., there is a case that a fixing property of the resin base particles at a low temperature is decreased.

A glass-transition temperature (Tg) of the straight chain type polyester resin is not particularly limited to a specific value, but is preferably in the range of 35 to 70° C., and more preferably in the range of 50 to 65° C.

If the glass-transition temperature (Tg) of the straight chain type polyester resin is lower than 35° C., there is a case that a blocking phenomenon (heat aggregation) of the resin base particles is likely to occur during storage or conveyance of the toner T, or when it is subjected to a high temperature in the developing device.

On the other hand, if the glass-transition temperature (Tg) of the straight chain type polyester resin exceeds 70° C., there is a case that a fixing property of the resin base particles at a low temperature is decreased.

A softening point of the cross-link type polyester resin is not particularly limited to a specific value, but is preferably equal to or higher than 150° C., more preferably in the range of 150 to 220° C., and even more preferably in the range of 170 to 190° C.

If the softening point of the cross-link type polyester resin is lower than 150° C., there is a case that since the resin base particles are aggregated easily, troubles are likely to occur during storage of the toner T or when a printing is carried out. On the other hand, if the softening point of the cross-link type polyester resin exceeds 220° C., there is a case that a fixing property of the resin base particles is decreased.

A softening point of the straight chain type polyester resin is not particularly limited to a specific value, but is preferably equal to or higher than 90° C., more preferably in the range of 90 to 130° C., and even more preferably in the range of 90 to 110° C.

If the softening point of the straight chain type polyester resin is lower than 90° C., there is a case that since the resin base particles are aggregated easily due to decrease of the glass-transition temperature thereof, troubles are likely to occur during storage of the toner T or when a printing is carried out. On the other hand, if the softening point of the straight chain type polyester resin exceeds 130° C., there is a case that a fixing property of the resin base particles is lowered.

Here, the softening point of the polyester resin is a T1/2 temperature measured using a constant stress extrusion capillary rheometer ("Flow Tester CFT-500", produced by Shimadzu Corporation). The measurement is carried out under the conditions in that a piston sectional area is 1 $cm^2$, a cylinder pressure is 0.98 MPa, a die length is 1 mm, a die hole diameter is 1 mm, a measurement starting temperature is 50° C., a heating rate is 6° C./min, and a sample mass is 1.5 g.

Further, the glass-transition temperature (Tg) of the polyester resin is measured using a DSC ("DSC-60A", produced by Shimadzu Corporation).

Specifically, the measurement is carried out by placing 20 mg of a sample into a crimp cell made of aluminum, heating the sample up to 180° C. at a heating rate of 10° C./min, cooling the sample up to a normal temperature from 180° C. at a cooling rate of 10° C./min, and once again heating the sample up to 180° C. at a heating rate of 10° C./min.

And when the sample has been heated at the second heating process, a temperature, at which a phase transition of the sample occurs, that is, an endothermic peak is observed, is defined as "Tg".

Furthermore, the above mentioned coloring resin liquid may be prepared by mixing a charge control agent.

Second Step

In this step (emulsifying step), a basic compound and water are added into the coloring resin liquid prepared in the first step described above in the named order. In this way, an emulsification suspension in which the coloring resin liquid is emulsified into an aqueous medium in the form of oil droplets is obtained.

Namely, the emulsification suspension (that is, a dispersion liquid), in which the oil droplets of the coloring resin liquid (oil droplets of the dispersoid containing the binder resin and the coloring agent) are dispersed (emulsified and/or suspended), is obtained.

In this case, it is preferred that the water is added little by little into the coloring resin liquid containing the binder resin having carboxyl groups neutralized by the basic compound with being stirred.

By neutralizing the carboxyl groups, the binder resin can have an improved polarity as compared with a state that the carboxyl groups are not neutralized. As a result, molecules of the binder resin are attracted with each other due to enhancement of acid-base interaction, and therefore a viscosity of a system containing the coloring resin liquid is increased according to addition of the water.

Further, since hydrophilicity of the binder resin is improved due to polarizing of the carboxyl groups, affinity of the binder resin to water can be improved. Therefore, by continuing addition of water, the neutralized carboxyl groups are sequentially hydrated by the water. As a result, the coloring resin liquid is changed into the form of oil droplets due to the hydration of the carboxyl groups in addition to an effect of the stirring.

Thereafter, when a certain amount of water is added into the system, the system becomes a state that the oil droplets of the coloring resin liquid are dispersed in the aqueous medium. At or around this state, decrease of the viscosity of the system is started. The point at which these phenomenons occur is referred to as "phase inversion point".

Therefore, when water is added into the system steadily, the viscosity of the system is increased until just before the phase inversion point, arrives at a maximum value, and then is decreased just after the viscosity has reached the phase inversion point. Such a viscosity rise is related to an added amount of the basic compound, that is, the greater the added amount of the basic compound is, the larger the viscosity rises.

On the other hand, the amount of the basic compound affects not only a size or shape uniformity of the oil droplets of the coloring resin liquid and a formation speed thereof in the emulsifying step (that is, the second step), but also a size or shape uniformity of aggregated oil droplets (that is, coloring resin fine oil droplets) which will be formed and a formation speed thereof in an aggregating step (that is, a third step) described below.

An added amount of the basic compound to the carboxyl groups of the binder resin is preferably in the range of 1 to 3 equivalents, and more preferably in the range of 1 to 2 equivalents.

By adding an excess amount of the basic compound greater than an amount required for neutralizing all of the carboxyl groups of the binder resin, it is possible to prevent aggregated oil droplets having an irregularity shape from being formed in the aggregating step, and to obtain resin base particles having narrow particle size distribution.

At the end of the emulsifying step, a ratio of the organic solvent to a total amount of the organic solvent and the water is preferably in the range of 20 to 35 mass %, and more preferably in the range of 20 to 30 mass %.

As described above, the smaller the amount of the organic solvent used in the coloring resin liquid preparing step is, the smaller the amount of the water to be used for arriving at the phase inversion point becomes, whereas the larger the amount of the organic solvent used in the coloring resin liquid preparing step is, the larger the amount of the water to be used for arriving at the phase inversion point becomes.

In this regard, if there is a case that the coloring resin liquid is not finely dispersed into the aqueous medium completely due to a high viscosity of the system (emulsification suspension) at the phase inversion point, it is preferred that water is further added into the system.

In this case, an amount of the water to be incrementally added is preferably in the range of 50 to 80 mass % of a total amount of the water which will be added into the coloring resin liquid after the phase inversion point and the water which has been added into the coloring resin liquid before the phase inversion point.

Examples of the basic compound used for neutralizing include: inorganic bases such as sodium hydroxide, potassium hydroxide and ammonia; organic bases such as diethylamine, triethylamine, isopropylamine; and the like. In particular, the inorganic bases such as the sodium hydroxide, the potassium hydroxide and the ammonia are preferably used as the basic compound. In this regard, it is to be noted that these inorganic bases are preferably used by preparing an aqueous solution thereof.

In the emulsification suspension prepared according to the above method, the coloring resin liquid exists in a state that it is emulsified into the aqueous medium, that is, oil droplets thereof are dispersed into the aqueous medium.

Such a state is different depending on kinds of the organic solvents to be used, an used amount thereof, an acid number of the binder resin, an used amount of the basic compound, stirring conditions of the system (coloring resin liquid) or the like, but a state in which the coloring resin liquid containing the binder resin, the wax, the coloring agent and the like is emulsified (dispersed) in the form of oil droplets each having a size (oil droplet size) of less than 1 μm into the aqueous medium is preferred.

According to such a state, it is possible to improve a stability of the emulsified state of the emulsification suspension, a stability of an aggregation efficiency of the oil droplets of the coloring resin liquid and size distribution of the aggregated oil droplets (coloring resin fine oil droplets) in the next step, and the like.

Third Step

In this step (aggregating step), by adding an electrolyte into the emulsification suspension, the oil droplets of the coloring resin liquid (that is, fine oil droplets composed of the coloring resin liquid or oil droplets of the dispersoid) are salted out or destabilized so that aggregation is progressed by unifying the oil droplets of the coloring resin liquid to thereby form aggregated oil droplets. In particular, the electrolyte is preferably used in the form of an electrolyte aqueous solution.

Examples of the electrolyte to be used in this step include water soluble salts such as sodium sulfate, ammonium sulfate, potassium sulfate, magnesium sulfate, sodium phosphate, sodium dihydrogen phosphate, sodium chloride, potassium chloride, ammonium chloride, calcium chloride, sodium acetate and the like. Any one of these electrolytes may be used singly, or two or more of these electrolytes may be used in combination.

From a viewpoint of progressing uniform aggregation of the oil droplets of the coloring resin liquid, sulfate salts each including a monovalent cation such as the sodium sulfate and the ammonium sulfate are preferably used as the electrolyte.

Further, since a hydration state of aggregated oil droplets (coloring resin fine oil droplets) to be obtained, in which the binder resin swelled by the organic solvent are contained, becomes a nervous condition due to the added electrolyte, it is preferred that the aggregation of the oil droplets of the coloring resin liquid is carried out at a low shearing force so as to progress the aggregation preferentially without collapsing the aggregated oil droplets.

In order to aggregate the oil droplets of the coloring resin liquid uniformly, stirring conditions are important factors in the aggregating step. Examples of a stirring blade that can be used include an anchor blade, a turbine blade, a pfaudler blade, a fullzone blade, a maxblend blade (trademark, produced by Sumitomo Heavy Industries, Ltd.), a crescentic blade, and the like.

In particular, among these blades, large scale blades such as the maxblend blade and the fullzone blade are preferably used. By using such large scale blades, the emulsification suspension can be mixed uniformly at a low rotational speed.

From a viewpoint of formation of aggregated oil droplets having an uniform size and shape, a circumferential speed of the rotation of the stirring blade is preferably in the range of 0.2 to 10 m/s, more preferably in the range of 0.2 to 8 m/s, and even more preferably in the range of 0.2 to 6 m/s.

If the circumferential speed of the rotation of the stirring blade is faster than 10 m/s, there is a case that a part of the oil droplets of the coloring resin liquid remains in the form of fine oil droplets without being aggregated in the emulsification suspension.

On the other hand, if the circumferential speed of the rotation of the stirring blade is slower than 0.2 m/s, there is a case that the emulsification suspension is stirred ununiformly, and therefore excess aggregation is progressed partially so that coarse aggregated oil droplets are formed.

By setting the circumferential speed of the rotation of the stirring blade to a value within the above range, since the aggregation is progressed only by aggregation of the oil droplets of the coloring resin liquid, it is possible to prevent the oil droplets of the coloring resin liquid from being disassociated and dispersed. Therefore, in the aggregating step, it is possible to suppress remaining of the fine oil droplets and to obtain aggregated oil droplets having narrow size distribution.

For these reasons, it is preferred that the stirring of the coloring resin liquid preparing step and the emulsifying step are carried out by using a high speed stirrer such as a Despa, whereas the stirring of the aggregating step is carried out by using the large scale blade which can mix materials uniformly at a low rotational speed such as the maxblend blade.

Therefore, it is preferred that the emulsification suspension obtained in the emulsifying step is displaced into another container provided with the large scale blade, and then the aggregating step is carried out within the container.

Further, an amount of the electrolyte to a solid content is preferably in the range of 0.5 to 15 mass %, more preferably in the range of 1 to 12 mass %, and even more preferably in the range of 1 to 6 mass %.

If the amount of the electrolyte to the solid content is less than 0.5 mass %, there is a case that the aggregation is not progressed sufficiently. On the other hand, if the amount of the electrolyte to the solid content exceeds 15 mass %, there is a case that a productivity of the resin base particles is decreased due to needing a large amount of stopping water and taking long time to wash and dry them in the subsequent steps.

Further, concentration of the electrolyte aqueous solution (that is, an amount of the electrolyte contained in the electrolyte aqueous solution) is preferably in the range of 1 to 15 mass %, and more preferably in the range of 3 to 10 mass %.

If the concentration of the electrolyte aqueous solution is lower than 1 mass %, there is a case that since an effect of the electrolyte is not exhibited sufficiently, a large amount of the electrolyte aqueous solution needs to be added into the coloring resin liquid in order to salt out or aggregate the oil droplets of the coloring resin liquid. In this case, there is a fear that the aggregated oil droplets cannot be formed.

On the other hand, if the concentration of the electrolyte aqueous solution exceeds 15 mass %, there is a case that since an unevenness of the electrolyte concentration is caused in a system (that is, the emulsification suspension) easily, unnecessary aggregated products are formed in an initial stage of the aggregating step so that coarse aggregated oil droplets are likely to be formed.

When the electrolyte aqueous solution is added into the emulsification suspension in the aggregating step, it is preferred that a stirring speed of the emulsification suspension is set to a high speed in order to mix the electrolyte with the system uniformly and rapidly.

Further, in the aggregating step, it is possible to form the aggregated oil droplets at a condition of a relatively low temperature. Specifically, a temperature of the emulsification suspension is preferably in the range of 10 to 50° C., more preferably in the range of 20 to 40° C., and even more preferably in the range of 20 to 35° C.

If the temperature of the emulsification suspension is lower than 10° C., there is a case that it becomes difficult for the aggregation of the oil droplets of the coloring resin liquid to progress. On the other hand, if the temperature of the emulsification suspension exceeds 50° C., there is a case that an aggregating rate becomes fast, as a result of which unnecessary aggregated products and coarse aggregated oil droplets are likely to be formed.

In the aggregating step, the oil droplets of the coloring resin liquid, in which the binder resin swelled by the organic solvent is contained, are collided and fused with each other so that the aggregated oil droplets are formed and grown. Further, the oil droplet growth progresses in a substantially constant growth speed under a constant condition.

Therefore, the oil droplet growth can be represented by an oil droplet growth curve which is obtained by plotting a relation between a time and a size. As a result, by utilizing the obtained oil droplet growth curve, a time when the aggregated oil droplets arrive at a targeted size can be predicted.

As for a method for stopping the aggregation, a method in which water is added into the system (emulsification suspension) is preferably used.

Fourth Step

In this step (separating and drying step), the organic solvent is removed from the aggregated oil droplets, they are separated from the aqueous medium, and then are washed and dried, to thereby obtain the resin base particles. In this regard, it is to be noted that from a viewpoint of completing removal of the organic solvent (desolvent) at a condition of a low temperature speedily, the removal is preferably carried out under reduced pressure.

In the case where the desolvent is carried out, it is preferred that a defoaming agent is added into the emulsification suspension. A silicone-based emulsion type defoaming agent is preferably used as the defoaming agent. Examples of the silicone-based defoaming agent include: BY22-517, SH5503, SM5572F and BY28-503 (each produced by Toray Dow Corning Co., Ltd.); KM75, KM89, KM98, KS604 and KS538 (each produced by Shinetsu Chemical Co., Ltd.); and the like.

Among them, the BY22-517 is preferably used as the defoaming agent. This is because it has a less adverse effect on a physical property of the aggregated oil droplets to be obtained, and a high defoaming effect. An added amount of the defoaming agent to a solid content is preferably in the range of 30 to 100 ppm.

Separation of the resin base particles from the aqueous medium can be carried out using separating means such as a centrifugal separator, a filter press and a belt filter. Further, the drying can be carried out using various kinds of dryers.

Examples of the dryers include: mixing vacuum dryers such as a ribocone type dryer (produced by Okawara MFG. Co., Ltd.) and a nauta mixer (produced by Hosokawa Micron Corporation); fluid bed type dryers such as a fluid bed dryer (produced by Okawara MFG. CO., LTD.) and a vibration fluid bed dryer (produced by Chuo Kakohki CO., Ltd.); and the like.

Fifth Step

In this step (externally adding step), an externally added agent such as silica fine particles, and silicone oil and/or fluoro oil are externally added to the obtained resin base particles to thereby obtain a toner T. As described above, an added amount of the silicone oil and/or fluoro oil to the resin base particles is in the range of 0.05 to 2 mass %.

In this step, when the resin base particles and the silicone oil and/or fluoro oil are mixed with each other, a bulk density of a toner T to be obtained can be controlled by adjusting a mixing time thereof. Specifically, it is preferred that the mixing time is adjusted to a range that the toner T to be obtained can have the bulk density of 0.25 to 0.35 g/cm$^3$.

Further, in this step, other components can be externally added to the resin base particles, in addition to the externally added agents such as silica fine particles, and the silicone oil and/or fluoro oil.

In this way, a toner T can be obtained.

According to the developing device 54 having the structure as described above, although each of the resin base particles constituting the toner T has a small particle size, the aggregates of the resin base particles can behave as though they are large particle size toner particles within the toner receiving portion 21 and on the developing roller 3. Whereas the resin base particles can behave as small particle size toner particles on the photosensitive dram 20.

In addition, by contact of the aggregates with the irregularity section 33, particle sizes of the aggregates can be equalized, and the silicone oil and/or fluoro oil can be dispersed uniformly in the toner T. Therefore, a printing image having high resolution and a high quality level can be formed, while resolving various problems resulted from the use of the small particle size toner particles.

In the above, the developing device and the image forming apparatus according to the invention have been described based on each illustrated embodiment, but the invention is not limited to these structures. Each component or element constituting the developing device and the image forming apparatus may be replaced by an arbitrary component or element that can exhibit a similar function. Moreover, other arbitrary component or element may be added if necessary.

Further, a shape of an irregularity section to be formed on the outer peripheral surface of the developing roller is not limited to that of the irregularity section described in the above embodiment. For example, 4 cross points, at which two adjacent first grooves and two adjacent second grooves intersect, may be provided in a misaligned manner in an axis line direction of the developing roller.

EXAMPLES

Hereinbelow, a description will be made with regard to actual examples of the invention.

Example 1

Production of Toner

Synthesis of Binder Resin (Cross-link Type Polyester Resin)

Acids, alcohols and a catalyst as described below were put in a 50 L type reaction kettle as starting materials, and then a polymerization reaction was carried out under an atmospheric pressure in a nitrogen gas stream at 240° C. for 12 hours. Thereafter, the pressure was reduced little by little, and the polymerization reaction was continued to be carried out at a pressure of 10 mmHg.

A softening point was measured based on American Society for Testing and Materials (ASTM) E28-517. And the polymerization reaction was completed at a point that the softening point reached to 160° C.

| | |
|---|---|
| Terephthalic acid | 3.9 parts by mass |
| Isophthalic acid | 9.06 parts by mass |
| Ethylene glycol | 2.54 parts by mass |
| Neopenthyl glycol | 4.26 parts by mass |
| Tetrabutylthitanate | 0.1 parts by mass |
| Epiclon 830 | 0.3 parts by mass |
| Cardura E | 0.1 parts by mass |

In this regard, it is to be noted that the Epiclon 830 (produced by Dainippon Ink and Chemicals, Inc.) was bisphenol F type epoxy resin having an epoxy equivalent of 170 g/eq, and Cardura E (produced by Shell Chemicals Japan Ltd.) was alkyl glycidyl ester having an epoxy equivalent of 250 g/eq.

The thus obtained polyester resin, that is, the cross-link type polyester resin had properties as follows. An appearance thereof was colorless solid, an acid number thereof was 11.0, a glass transition point (Tg) thereof was 60° C., and a softening point (T1/2 temperature) thereof was 178° C.

Further, a weight average molecular weight of the cross-link type polyester resin was measured under the conditions as follows by using a gel permeation chromatography (GPC) measuring device ("HLC-8120GPC", produced by Tosoh Corporation).

The conditions were set so that separation columns were used in combination with TSK-GEL, G5000HXL, G40HXL, G3000HXL, and G2000HXL which were produced by Tosoh Corporation, a temperature of the columns was 40° C., a solvent was 0.5 wt % tetrahydrofuran, a pore size of a filter was 0.2 μm, and a rate of the solvent was 1 ml/min.

Thus obtained measured value was converted based on a standard polystyrene. As a result, the weight average molecular weight of the cross-link type polyester resin was 250,000.

Synthesis of Binding Resin (Straight Chain Type Polyester Resin)

Acids, alcohols, and a catalyst as described below were put in a 50 L type reaction kettle as starting materials, and then a polymerization reaction was carried out under an atmospheric pressure in a nitrogen gas stream at 210° C. for 12 hours. Thereafter, the pressure was reduced little by little, and the polymerization reaction was continued to be carried out at a pressure of 10 mmHg.

A softening point was measured based on American Society for Testing and Materials (ASTM) E28-517. And the polymerization reaction was completed in a point that the softening point reached to 87° C.

| | |
|---|---|
| Terephthalic acid | 5.31 parts by mass |
| Isophthalic acid | 7.97 parts by mass |
| Ethylene glycol | 2.6 parts by mass |
| Neopenthyl glycol | 4.37 parts by mass |
| Tetrabutylthitanate | 0.1 parts by mass |

The thus obtained polyester resin, that is, the straight chain type polyester resin had properties as follows. An appearance thereof was colorless solid, an acid number thereof was 10.0, a glass transition point (Tg) thereof was 46° C., and a softening point (T1/2 temperature) thereof was 95° C.

Further, a weight average molecular weight of the straight chain type polyester resin was measured in the same manner as that of the cross-link type polyester resin. As a result, the weight average molecular weight of the straight chain type polyester resin was 5,200.

Preparation of Wax Master Dispersion Liquid 30 parts by mass of carnauba wax (produced by To a Kasei Co., Ltd.), 70 parts by mass of the above synthesized straight chain type polyester resin, and 150 parts by mass of methyl ethyl ketone were mixed using Despa (produced by Asada Iron Works. Co., Ltd.) in advance to obtain a mixture. Thereafter, the mixture was finely crushed using StarMill (produced by Ashizawa Finetech Ltd.) to thereby obtain a wax master dispersion liquid having a solid content of 40 mass %.

In this regard, it is to be noted that in the wax master dispersing liquid, a composition ratio of the straight chain type polyester resin/the carnauba wax/the methyl ethyl ketone was 28/12/60.

Preparation of Coloring Agent Master Chip 2,000 parts by mass of C. I. Pigment B-15:3 which was a cyanine type pigment ("Ket Bluelll", produced by Dainichiseika Color & Chemicals Mfg. Co., Ltd.) as a coloring agent, and 2,000 parts by mass of the straight chain type polyester resin were put in a 20 L type Henschel mixer (produced by Mitsui Mining Co., Ltd.) provided with a ST/AO stirring blade, and stirred at a stirring speed of 698 $min^{-1}$ for 2 minutes, to obtain a mixture.

Next, the mixture was melted and kneaded using an open roll continuous extrusion kneader ("Kneadex MOS140-800", produced by Mitsui Mining Co., Ltd.) to thereby obtain a coloring agent master chip.

Further, the obtained coloring agent master chip was mixed with straight chain type polyester resin and methyl ethyl ketone to obtain a mixture liquid. Thereafter, in the mixture liquid, presence or absence of coarse particles and a dispersion state of the coloring agent were checked using an optical microscope with being enlarged by 400 times. As a result, it is observed that coarse particles were absent and the coloring agent was uniformly dispersed in the mixture liquid.

In this regard, it is to be noted that in the coloring agent master chip, a composition ratio of the cyanine type pigment)/the straight chain type polyester resin was 50/50 by a mass ratio.

Coloring Resin Liquid Preparing Step 10.8 parts by mass of the wax master dispersion liquid, 10.4 parts by mass of the coloring agent master chip, 12 parts by mass of cross-link type polyester resin, 10 parts by mass of straight chain type polyester resin, and 8.65 parts by mass of methyl ethyl ketone were added.

Thereafter, the above materials were mixed using a stirrer provided with a stirring blade having a diameter of 230 mm ("Despa", produced by Asada Iron Works. Co., Ltd.) at a stirring speed of 777 $min^{-1}$ for 2 hours with being maintained at a temperature of 40 to 45° C. so as to dissolve and disperse them. In this way, a coloring resin solution was obtained.

Emulsifying Step 46.37 parts by mass of the coloring resin solution having a solid content of 30 parts by mass was put in a cylindrical container having a stirrer provided with a stirring blade having a diameter of 230 mm ("Despa", produced by Asada Iron Works. Co., Ltd.).

Thereafter, 5 parts by mass of 1 normal (N) ammonia water was added into the coloring resin solution as a basic compound, they were stirred at a stirring speed of 777 $min^{-1}$ sufficiently to obtain a mixture solution, and then a temperature of the mixture solution was set to 35° C.

Next, the stirring speed of the mixture solution was changed to 1,100 $min^{-1}$, and then 37.25 parts by mass of water was dropped into the mixture solution at a dropping speed of 1.0 part by mass/min to thereby obtain an emulsification suspension. At this time, a circumferential speed of the stirring blade was 13.2 m/s.

When addition of the water into a system containing the coloring resin solution (mixture solution) was continued, a viscosity of the system was increased. However, the dropped water was brought into the system immediately. As a result, the coloring resin solution and the water could be stirred and mixed uniformly.

Further, at a time when 26 parts by mass of the water was added into the system, a phase inversion point at which the viscosity of the system had been decreased drastically was observed. Subsequently, after the water was added into the system, the system was checked using an optical microscope.

As a result, observed was a state that the resins were dissolved in the system, and the coloring agent (cyanine type pigment) and the wax (carnauba wax) were dispersed in the system, that is, a state that non-emulsified matters were absent in the system. In other words, it could be confirmed that an emulsification suspension, in which oil droplets of the coloring resin liquid were emulsified into an aqueous medium, was obtained.

In such a emulsification suspension, since the coloring agent and the wax were existing in a stable dispersion state in the aqueous medium (water), it was supposed that the organic solvent, in which the resins were dissolved, was emulsified into the aqueous medium, and the coloring agent and the wax were dispersed into the organic solvent via the resins.

Further, at the above checking time, a state of the system (emulsification suspension) was uniform, and generation of coarse oil droplets could not be observed in the system.

Aggregating Step

The emulsification suspension obtained in the above emulsifying step was transferred into a cylindrical container having a maxblend blade (trademark) having a diameter of 340 mm, and then a stirring speed of the maxblend blade was set to 85 $min^{-1}$ and a temperature of the emulsification suspension was set to 25° C.

Thereafter, the stirring speed was raised to 120 $min^{-1}$ and then 12 parts by mass of 3.5 mass % sodium sulfate solution was dropped into the emulsification suspension as an electrolyte aqueous solution at a dropping speed of 1 kg/min to obtain a mixture solution.

When 5 minutes had elapsed after dropping of the sodium sulfate solution was completed, the stirring speed was depressed to 85 $min^{-1}$ and the mixture solution was stirred at this stirring speed for 5 minutes. Further, the stirring speed was depressed to 65 $min^{-1}$ and the mixture solution was stirred at this stirring speed for 5 minutes.

Next, the stirring speed was depressed to 47 $min^{-1}$ and the mixture solution was continued to be stirred at this stirring speed for 30 minutes. At this time, an average size Dv of aggregated oil droplets by aggregation of the oil droplets each composed of the coloring resin solution in volume basis was 3 μm. This average size Dv was measured using a flow type particle image analytical apparatus ("PFIA-2100", produced by Sysmex Corporation).

Separating and Drying Step

After the organic solvent (methyl ethyl ketone) was removed from the aggregated oil droplets, they were separated from the aqueous medium, and then were washed and dried, to thereby obtain resin base particles. An average particle size Dv in volume basis, an average particle size Dn in number basis and Dv/Dn of the obtained resin base particles were 2.9 μm, 2.66 μm and 1.09, respectively.

Externally Adding Step 2 parts by mass (weight) of negative electric silica fine particles subjected to a hexamethyldisilazane treatment and having an average particle size of 12 nm ("RX200", produced by Japan Aerosil Co.) and 1.5 parts by mass (weight) of negative electric silica fine particles subjected to a hexamethyldisilazane treatment and having an average particle size of 40 nm ("RX50", produced by Japan Aerosil Co.) were added into 100 parts by mass (weight) of the obtained resin base particles to obtain a mixture.

The mixture was stirred using a 1 L type stirrer ("7012S", produced by Commercial Corporation) at a stirring speed of 10,000 rpm for 3 minutes, and then 0.5 mass % (wt %) of dimethylsilicone oil having a kinetic viscosity at 25° C. of 200 $mm^2/s$ (measured by "KF-96-200CS" produced by Shinetsu Chemical Co., Ltd.) was added into the mixture and stirred at a stirring speed of 10,000 rpm for 1 minute in the same manner as described above, to thereby produce a toner.

Formation of Developing Roller

A developing roller was formed as follows.

First, a cylindrical base member made of STKM was prepared as a main body. The base-member had a length of 300 mm, an external diameter of 18 mm, and a thickness of 3 mm. Next, in each end portion of the base member in an axis line direction, a thickness of about 1 mm of an inner circumference portion thereof was removed using a cutting work so that the end portion was formed into a thin wall.

On the other hand, two columnar members made of STKM were prepared as shaft portions. Each of columnar members had a length of 50 mm and an external diameter of 14 mm. Thereafter, each of the columnar members was pressed into the inside of each end portion so as to expose a portion thereof having a length of about 30 mm.

Next, a structure consisted of the base member and a pair of the columnar members was ground by a center-less grind so that an axis line of the base member and an axis line of each of the columnar members are aligned to thereby obtain a developing roller.

Next, in order to form a plurality of first grooves and a plurality of second grooves, an outer peripheral surface of the base member was subjected to an irregularity process using a die made of SKD. Thereafter, a hard chromium plating film having a thickness of 3 μm was formed on the outer peripheral surface of the base member to thereby obtain an irregularity section including the first grooves and the second grooves.

In this regard, it is to be noted that the first grooves and the second grooves were formed so as to be perpendicular to each other, and inclined with respect to a segment extended along a circumferential direction of the outer peripheral surface of the base member (that is, a segment parallel to an axis line of the base member on the outer peripheral surface thereof).

An inclined angle of each of the first grooves with respect to the segment extended along the circumferential direction of the outer peripheral surface of the base member (that is, an inclined angle "θ1" of each of the first grooves with respect to the segment parallel to the axis line of the base member on the outer peripheral surface thereof) was 45'.

Similarly, an inclined angle of each of the second grooves with respect to the segment extended along a circumferential direction of the outer peripheral surface of the base member (that is, an inclined angle "θ2" of each of the second grooves with respect to the segment parallel to the axis line of the base member on the outer peripheral surface thereof) was also 45°.

Further, a pitch between the first grooves, a width of each first groove, and a depth of each first groove were 80 μm, 26 μm, and 6 μm, respectively. Similarly, a pitch between the second grooves, a width of each second groove, and a depth of each second groove were also 80 μm, 26 μm, and 6 μm, respectively.

Here, when a surface roughness of the outer peripheral surface of the developing roller (that is, the base member) was measured using a laser microscope ("VK-9500", produced by Keyence Corporation) according to JIS B0601-1994, the depth of each first groove and the depth of each second groove were defined by a maximum height "Ry".

Further, when a surface roughness of the outer peripheral surface of the developing roller was measured using a laser microscope ("VK-9500", produced by Keyence Corporation) according to JIS B0601-1994, the pitch between the first grooves and the pitch between the second grooves were defined by an average interval "Sm".

Formations of Developing Device and Image Forming Apparatus

The toner obtained as described above was filled into a cartridge for a color printer ("LP9000C", produced by Seiko Epson Corporation), and the cartridge and the above formed developing roller were set in the color printer, respectively.

In such a color printer, a sponge layer (that is, a elastic porous layer) provided in a toner supply roller had a plurality of cells (pores), and a size of each cell (that is, an average size of the pores) was 150 μm.

Here, when a surface roughness of the outer peripheral surface of the sponge layer was measured using a laser microscope ("VK-9500", produced by Keyence Corporation) according to JIS B0601-1994, the size of the cells was defined by an average interval "Sm".

Further, a spacer for adjusting a developing gap having a thickness of 50 μm was used. A developing bias voltage was adjusted by superimposing a direct voltage of −300 V to a rectangular wave current having a peak-peak voltage of 1000V and a frequency of 6,000 Hz. The other conditions were the same as the conditions originally set in the color printer (LP9000C).

Examples 2 to 5

In each of Examples 2 to 5, an image forming apparatus was formed in the same manner as in the Example 1 except that the added amount of the silicone oil was changed to a value described in the following Table 1.

TABLE 1

| | Toner | | | Developing roller | | Toner supply roller | Evaluation | | |
|---|---|---|---|---|---|---|---|---|---|
| | Average particle size of resin base particles [μm] | Added amount of silicone oil [mass %] | Kinetic viscosity of silicone oil (25° C.) [$mm^2/s$] | Depth (Ry) of each depression portion (groove) [μm] | Pitch (Sm) between depression portions (grooves) [μm] | Average size of pores [μm] | Developing efficiency [%] | Developing unevenness [%] | Line reproducibility |
| Ex. 1 | 2.9 | 0.5 | 200 | 6 | 80 | 150 | 80 | 0.1 or less | A |
| Ex. 2 | 2.9 | 0.05 | 200 | 6 | 80 | 150 | 78 | 0.1 or less | A |
| Ex. 3 | 2.9 | 0.1 | 200 | 6 | 80 | 150 | 78 | 0.1 or less | A |
| Ex. 4 | 2.9 | 1 | 200 | 6 | 80 | 150 | 80 | 0.1 or less | A |
| Ex. 5 | 2.9 | 1.9 | 200 | 6 | 80 | 150 | 65 | 0.1 or less | A |
| Ex. 6 | 3.5 | 0.5 | 200 | 6 | 80 | 150 | 80 | 0.1 or less | A |
| Ex. 7 | 2.9 | 0.5 | 200 | 2 | 80 | 150 | 65 | 0.3 | A |
| Ex. 8 | 2.9 | 0.5 | 200 | 3 | 80 | 150 | 78 | 0.1 | A |
| Ex. 9 | 2.9 | 0.5 | 200 | 6 | 120 | 150 | 78 | 0.1 or less | A |
| Ex. 10 | 2.9 | 0.5 | 200 | 6 | 140 | 150 | 80 | 0.1 or less | A |
| Ex. 11 | 2.9 | 0.5 | 200 | 6 | 170 | 150 | 75 | 0.3 | A |
| Ex. 12 | 2.9 | 0.5 | 200 | 6 | 200 | 150 | 70 | 0.3 | A |
| Ex. 13 | 2.9 | 0.5 | 20 | 6 | 80 | 150 | 72 | 0.3 | A |
| Ex. 14 | 2.9 | 0.5 | 350 | 6 | 80 | 150 | 63 | 0.3 | A |
| Comp. Ex. 1 | 2.9 | 0 | 200 | 6 | 80 | 150 | 82 | 0.3 | B |
| Comp. Ex. 2 | 2.9 | 2.5 | 200 | 6 | 80 | 150 | 32 | 0.3 | A |
| Comp. Ex. 3 | 1.9 | 0.5 | 200 | 6 | 80 | 150 | 40 | 0.3 | A |
| Comp. Ex. 4 | 4.1 | 0.5 | 200 | 6 | 80 | 150 | 80 | 0.1 or less | B |
| Comp. Ex. 5 | 2.9 | 0.5 | 200 | 6 (Blast) | 80 (Blast) | 150 | 76 | 0.3 | B |

Example 6

An image forming apparatus was formed in the same manner as in the Example 1 except that resin base particles having the average particle size described in the Table 1 were used.

In the Example 6, in the aggregating step, by changing the dropping amount of the 3.5 mass % sodium sulfate solution (electrolyte aqueous solution) to 13 parts by mass, the resin base particles having the average particle size described in the Table 1 were obtained.

Examples 7 and 8

In each of Examples 7 and 8, an image forming apparatus was formed in the same manner as in the Example 1 except that in the developing roller, the depth of the depression portions of the irregularity section was set to a value described in the Table 1.

Examples 9 to 12

In each of Examples 9 to 12, an image forming apparatus was formed in the same manner as in the Example 1 except that in the developing roller, the pitch between the protrusion portions or depression portions of the irregularity section was set to a value described in the Table 1.

Examples 13 and 14

In each of Examples 13 and 14, an image forming apparatus was formed in the same manner as in the Example 1 except that silicone oil having a kinetic viscosity at 25° C. described in the Table 1 was used.

In the Example 13, dimethylsilicone oil having a kinetic viscosity at 25° C. of 20 $mm^2/s$ (measured by "KF-96-20CS" produced by Shinetsu Chemical Co., Ltd.) was used as the silicone oil. Further, in the Example 14, dimethylsilicone oil having a kinetic viscosity at 25° C. of 350 $mm^2/S$ (measured by "KF-96-350CS" produced by Shinetsu Chemical Co., Ltd.) was used as the silicone oil.

Comparative Examples 1 and 2

In each of Comparative Examples 1 and 2, an image forming apparatus was formed in the same manner as in the Example 1 except that an added amount of the silicone oil was changed to a value described in the Table 1.

Comparative Examples 3 and 4

In each of Comparative Examples 3 and 4, an image forming apparatus was formed in the same manner as in the Example 1 except that resin base particles having the average particle size described in the Table 1 were used.

In the Comparative Example 3, in the aggregating step, by changing the dropping amount of the 3.5 mass % sodium sulfate solution to 8 parts by mass, the resin base particles having the average particle size described in the Table 1 were obtained.

Further, in the Comparative Example 4, in the aggregating step, by changing the dropping amount of the 3.5 mass % sodium sulfate solution to 16 parts by mass, the resin base particles having the average particle size described in the Table 1 were obtained.

Comparative Example 5

An image forming apparatus was formed in the same manner as in the Example 1 except that in the developing roller, the irregularity section was formed using a blast treatment as described in the Table 1.

Evaluation

For the image forming apparatuses formed as described above, evaluations were made according to the following evaluation tests. The obtained results were described in the Table 1.

Developing Efficiency

In each of the image forming apparatuses of the Examples 1 to 14 and the Comparative Examples 1 to 5, an adhesive tape was attached to the outer peripheral surface of the developing roller carrying the toner, and then removed therefrom. On the other hand, another adhesive tape was attached to the outer peripheral surface of the photosensitive dram carrying the toner transferred from the developing roller, and then removed therefrom.

Thereafter, an amount of the toner attached to each of the adhesive tapes was measured. Based on the measurement values, a developing efficiency, which is defined by a ratio of (the amount of the toner obtained from the photosensitive dram)/(the amount of the toner obtained from the developing roller), was calculated.

Developing Unevenness

In each of the image forming apparatuses of the Examples 1 to 14 and the Comparative Examples 1 to 5, a printing image having an image density of 30% was formed onto an A3 size electrophotographic plain paper. In any 20 points of the formed printing image, OD values thereof were measured. A ratio of an average value of the OD values to a maximum OD value among them was represented by percentage.

Line Reproducibility

In each of the image forming apparatuses of the Examples 1 to 14 and the Comparative Examples 1 to 5, a negative image composed of a line having a width of 40 μm was printed onto an electrophotographic plain paper, and then the negative image was observed using a microscope. Then based on the observed results, a line reproducibility (image reproducibility) was evaluated according to the following two criteria.

A: The line having a width of 40 μm was reproduced correctly.

B: The line having a width of 40 μm was not reproduced correctly, and breaking and thickening of the line were observed at a middle portion thereof.

As shown in the Table 1, each of the Examples according to the invention had an excellent line reproducibility (that is, high resolution). In addition, in each of the Examples, the developing efficiency was high and the developing unevenness could be suppressed at a low level. Especially, in each of the Examples 1 to 4, 6, 9 and 10, the developing efficiency was very high and the developing unevenness could be suppressed at a very low level.

In contrast, a result of each of the Comparative Examples was worse than that of each of the Examples. Especially, in each of the Comparative Examples 1, 4 and 5, the line reproducibility was especially low. Further, in each of the Comparative Examples 2 and 3, the developing efficiency was especially low.

What is claimed is:

1. A developing device, comprising:

a toner constituted of resin base particles containing a coloring agent and a binder resin, and silicone oil and/or fluoro oil added to the resin base particles;

a toner receiving portion for receiving the toner; and a developing roller having an outer peripheral surface and an irregularity section for carrying the toner, the irregularity section formed on the outer peripheral surface and including a plurality of depression portions and/or protrusion portions provided regularly and uniformly;

wherein a volume average particle size of the resin base particles is in the range of 2 to 4 μm, and an added amount of the silicone oil and/or fluoro oil to the resin base particles is in the range of 0.05 to 2 mass %.

2. The developing device as claimed in claim 1, wherein the irregularity section includes a plurality of first grooves extending in a mutually parallel relationship and a plurality of second grooves intersecting the first grooves and extending in a mutually parallel relationship.

3. The developing device as claimed in claim 2, wherein the irregularity section is formed using a die rolling method.

4. The developing device as claimed in claim 2, wherein a depth of each first groove and/or each second groove is larger than the average particle size of the resin base particles.

5. The developing device as claimed in claim 4, wherein the depth of each first groove and/or each second groove is equal to or smaller than 2 times of the average particle size of the resin base particles.

6. The developing device as claimed in claim 2, wherein the developing device further comprises a toner supply roller provided so as to make contact with the developing roller, the toner supply roller having an outer peripheral surface and supplying the toner to the irregularity section of the developing roller while retaining the toner on the outer peripheral surface thereof.

7. The developing device as claimed in claim 2, wherein the developing device further compries a restriction blade provided so as to make contact with the outer peripheral surface of the developing roller for restricting an amount of the toner on the irregularity section of the developing roller to a predetermined amount.

8. The developing device as claimed in claim 2, wherein each first groove and each second groove extend in a direction inclined with respect to a circumferential direction of the outer peripheral surface of the developing roller.

9. The developing device as claimed in claim 1, wherein in the case where the average particle size of the resin base particles in volume basis is defined as "Dv" and an average particle size of the resin base particles in number basis is defined as "Dn", Dv/Dn is in the range of 1 to 1.1.

10. The developing device as claimed in claim 1, wherein the silicone oil is dimethylsilicone oil.

11. The developing device as claimed in claim 10, wherein a kinetic viscosity at 25° C. of the dimethylsilicone oil is in the range of 50 to 300 $mm^2/s$.

12. An Image forming apparatus, comprising:

a latent image carrier for carrying a latent image thereon; and a developing device for visualizing the latent image as a toner image by applying a toner, which is constituted of resin base particles containing a coloring agent and a binder resin, and silicone oil and/or fluoro oil added to the resin base particles, to the latent image carrier, wherein the developing device comprising the toner, a toner receiving portion for receiving the toner, and a developing roller having an outer peripheral surface and an irregularity section for carrying the toner, the irregularity section formed on the outer peripheral surface and including a plurality of depression portions and/or protrusion portions provided regularly and uniformly, wherein a volume average particle size of the resin base particles is in the range of 2 to 4 μm, and an added amount of the silicone oil and/or fluoro oil to the resin base particles is in the range of 0.05 to 2 mass %.

* * * * *